US011377720B2

(12) United States Patent
Na et al.

(10) Patent No.: US 11,377,720 B2
(45) Date of Patent: Jul. 5, 2022

(54) BULK NICKEL-SILICON-BORON GLASSES BEARING CHROMIUM

(71) Applicant: Glassimetal Technology Inc., Pasadena, CA (US)

(72) Inventors: Jong Hyun Na, Pasadena, CA (US); Michael Floyd, Pasadena, CA (US); Glenn Garrett, Pasadena, CA (US); Marios D. Demetriou, West Hollywood, CA (US); William L. Johnson, San Marino, CA (US)

(73) Assignee: Glassimetal Technology Inc., Pasadena, CA (US)

( * ) Notice: Subject to any disclaimer, the term of this patent is extended or adjusted under 35 U.S.C. 154(b) by 0 days.

(21) Appl. No.: 14/029,719

(22) Filed: Sep. 17, 2013

(65) Prior Publication Data

US 2014/0076467 A1 Mar. 20, 2014

Related U.S. Application Data

(60) Provisional application No. 61/847,961, filed on Jul. 18, 2013, provisional application No. 61/702,007, filed on Sep. 17, 2012.

(51) Int. Cl.

| | |
|---|---|
| ***C22C 45/04*** | (2006.01) |
| ***C22F 1/10*** | (2006.01) |
| *C22F 1/00* | (2006.01) |

(52) U.S. Cl.

CPC ..... *C22C 45/04* (2013.01); *C22F 1/10* (2013.01); *C22F 1/002* (2013.01)

(58) Field of Classification Search

None

See application file for complete search history.

(56) References Cited

U.S. PATENT DOCUMENTS

| | | | |
|---|---|---|---|
| 3,856,513 | A | 12/1974 | Chen et al. |
| 4,050,931 | A | 9/1977 | Tanner et al. |

(Continued)

FOREIGN PATENT DOCUMENTS

| | | |
|---|---|---|
| CN | 1354274 | 6/2002 |
| CN | 1653200 | 8/2005 |

(Continued)

OTHER PUBLICATIONS

JP2007-075867 machine translation.*

(Continued)

*Primary Examiner* — Paul A Wartalowicz
*Assistant Examiner* — Stephani Hill
(74) *Attorney, Agent, or Firm* — KPPB LLP

(57) ABSTRACT

Nickel based alloys capable of forming bulk metallic glass are provided. The alloys include Ni—Cr—Si—B compositions, with additions of P and Mo, and are capable of forming a metallic glass rod having a diameter of at least 1 mm. In one example of the present disclosure, the Ni—Cr—Mo—Si—B—P composition includes about 4.5 to 5 atomic percent of Cr, about 0.5 to 1 atomic percent of Mo, about 5.75 atomic percent of Si, about 11.75 atomic percent of B, about 5 atomic percent of P, and the balance is Ni, and wherein the critical metallic glass rod diameter is between 2.5 and 3 mm and the notch toughness between 55 and 65 MPa $m^{1/2}$.

8 Claims, 19 Drawing Sheets

(56) References Cited

U.S. PATENT DOCUMENTS

| | | | | |
|---|---|---|---|---|
| 4,116,682 | A | 9/1978 | Polk et al. | |
| 4,126,284 | A | 11/1978 | Ichikawa et al. | |
| 4,144,058 | A | 3/1979 | Chen et al. | |
| 4,152,144 | A | 5/1979 | Hasegawa et al. | |
| 4,385,932 | A | 5/1983 | Inomata et al. | |
| 4,385,944 | A | 5/1983 | Hasegawa | |
| 4,582,536 | A | 4/1986 | Raybould | |
| 4,892,628 | A | 1/1990 | Guilinger | |
| 4,900,638 | A | 2/1990 | Emmerich | |
| 4,968,363 | A | 11/1990 | Hashimoto et al. | |
| 5,158,229 | A * | 10/1992 | Bose | B23K 35/304 228/262.1 |
| 5,288,344 | A | 2/1994 | Peker et al. | |
| 5,338,376 | A | 8/1994 | Liu et al. | |
| 5,429,725 | A | 7/1995 | Thorpe et al. | |
| 5,634,989 | A | 6/1997 | Hashimoto et al. | |
| 6,004,661 | A | 12/1999 | Sakai et al. | |
| 6,303,015 | B1 | 10/2001 | Thorpe et al. | |
| 6,325,868 | B1 | 12/2001 | Kim et al. | |
| 6,695,936 | B2 | 2/2004 | Johnson | |
| 7,008,490 | B2 | 3/2006 | Peker | |
| 8,052,923 | B2 | 11/2011 | Langlet | |
| 8,287,664 | B2 | 10/2012 | Brunner | |
| 9,863,025 | B2 | 1/2018 | Na et al. | |
| 10,458,008 | B2 | 10/2019 | Na et al. | |
| 2005/0263216 | A1 | 12/2005 | Chin et al. | |
| 2006/0213586 | A1 | 9/2006 | Kui | |
| 2006/0231169 | A1 | 10/2006 | Park et al. | |
| 2007/0048164 | A1 | 3/2007 | Demetriou et al. | |
| 2007/0175545 | A1 | 8/2007 | Urata et al. | |
| 2009/0101244 | A1 | 4/2009 | Ogawa et al. | |
| 2009/0110955 | A1 | 4/2009 | Hartman et al. | |
| 2009/0114317 | A1 | 5/2009 | Collier et al. | |
| 2010/0028716 | A1 * | 2/2010 | Nuetzel | B23K 35/3033 428/679 |
| 2012/0073710 | A1 | 3/2012 | Kim et al. | |
| 2012/0168037 | A1 | 7/2012 | Demetriou et al. | |
| 2013/0048152 | A1 | 2/2013 | Na et al. | |
| 2013/0263973 | A1 | 10/2013 | Kurahashi et al. | |
| 2014/0096873 | A1 | 4/2014 | Na et al. | |
| 2014/0116579 | A1 | 5/2014 | Na et al. | |
| 2014/0118652 | A1 | 5/2014 | Zhang et al. | |
| 2014/0130942 | A1 | 5/2014 | Floyd et al. | |
| 2014/0130945 | A1 | 5/2014 | Na et al. | |
| 2014/0190593 | A1 | 7/2014 | Na et al. | |
| 2014/0213384 | A1 | 7/2014 | Johnson et al. | |
| 2014/0238551 | A1 | 8/2014 | Na et al. | |
| 2015/0047755 | A1 | 2/2015 | Na et al. | |
| 2015/0158126 | A1 | 6/2015 | Hartmann et al. | |
| 2015/0159242 | A1 | 6/2015 | Na et al. | |
| 2015/0176111 | A1 | 6/2015 | Na et al. | |
| 2015/0197837 | A9 | 7/2015 | Schramm et al. | |
| 2015/0240336 | A1 | 8/2015 | Na et al. | |
| 2016/0047023 | A1 | 2/2016 | Na et al. | |
| 2016/0060739 | A1 | 3/2016 | Na et al. | |
| 2016/0090644 | A1 | 3/2016 | Na et al. | |
| 2018/0312949 | A1 | 11/2018 | Na et al. | |

FOREIGN PATENT DOCUMENTS

| | | | | |
|---|---|---|---|---|
| DE | 3929222 | | 3/1991 | |
| DE | 10 2011 001 784 | | 10/2012 | |
| DE | 102011001783 | | 10/2012 | |
| EP | 0014335 | | 8/1980 | |
| EP | 0161393 | | 11/1985 | |
| EP | 0260706 | | 3/1988 | |
| EP | 1077272 | A1 * | 2/2001 | C23C 4/06 |
| EP | 1108796 | | 6/2001 | |
| EP | 1522602 | | 4/2005 | |
| JP | 54-76423 | | 6/1979 | |
| JP | S55-148752 | | 11/1980 | |
| JP | S57-13146 | | 1/1982 | |
| JP | 60002641 | A * | 1/1985 | |
| JP | 63-079930 | | 4/1988 | |
| JP | 63079931 | | 4/1988 | |
| JP | 63-277734 | | 11/1988 | |
| JP | 1-205062 | | 8/1989 | |
| JP | 08-269647 | | 10/1996 | |
| JP | 11-71659 | | 3/1999 | |
| JP | 2001-049407 | | 2/2001 | |
| JP | 2007075867 | A * | 3/2007 | B23K 35/30 |
| WO | WO 2012/053570 | | 4/2012 | |
| WO | WO 2013/028790 | | 2/2013 | |
| WO | 2014043722 | A2 | 3/2014 | |

OTHER PUBLICATIONS

JP 60-002641 (Year: 1985).*

Partial written English translation of JP S60-002641 claims 1-3 (Year: 1985).*

Updated written English translation of claims 1-3 of JP 60-002641 (Year: 1985).*

Park T.G. et al., "Development of new Ni-based amorphous alloys containing no metalloid that have large undercooled liquid regions," *Scripta Materialia*, vol. 43, No. 2, 2000, pp. 109-114.

Mitsuhashi A. et al., "The corrosion behavior of amorphous nickel base alloys in a hot concentrated phosphoric acid," *Corrosion Science*, vol. 27, No. 9, 1987, pp. 957-970.

Kawashima A. et al., "Change in corrosion behavior of amorphous Ni—P alloys by alloying with chromium, molybdenum or tungsten," *Journal of Non-Crystalline Solids*, vol. 70, No. 1, 1985, pp. 69-83.

Abrosimova G. E. et al., "Phase segregation and crystallization in the amorphous alloy $Ni_{70}MO_{10}P_{20}$," *Physics of the Solid State*, vol. 40., No. 9, 1998, pp. 1429-1432.

Yokoyama M. et al., "Hot-press workability of Ni-based glassy alloys in supercooled liquid state and production of the glassy alloy separators for proton exchange membrane fuel cell," *Journal of the Japan Society of Powder and Powder Metallurgy*, vol. 54, No. 11, 2007, pp. 773-777.

Rabinkin et al., "Brazing Stainless Steel Using New MBF-Series of Ni—Cr—B—Si Amorphous Brazing Foils: New Brazing Alloys Withstand High-Temperature and Corrosive Environments," *Welding Research Supplement*, 1998, pp. 66-75.

Chen S.J. et al., "Transient liquid-phase bonding of T91 steel pipes using amorphous foil," *Materials Science and Engineering A*, vol. 499, No. 1-2, 2009, pp. 114-117.

Hartmann, Thomas et al., "New Amorphous Brazing Foils for Exhaust Gas Application," *Proceedings of the 4th International Brazing and Soldering Conference*, Apr. 26-29, 2009, Orlando, Florida, USA.

Habazaki et al., "Preparation of corrosion-resistant amorphous Ni—Cr—P—B bulk alloys containing molybdenum and tantalum," *Material Science and Engineering*, A304-306, 2001, pp. 696-700.

Zhang et al., "The Corrosion Behavior of Amorphous Ni—Cr—P Alloys in Concentrated Hydrofluoric Acid," *Corrosion Science*, vol. 33, No. 10, pp. 1519-1528, 1992.

Katagiri et al., "An attempt at preparation of corrosion-resistant bulk amorphous Ni—Cr—Ta—Mo—P—B alloys," *Corrosion Science*, vol. 43, No. 1, pp. 183-191, 2001.

U.S. Appl. No. 14/824,733, filed Aug. 12, 2015, Jong Hyun Na et al.

Habazaki et al., "Corrosion behaviour of amorphous Ni—Cr—Nb—P—B bulk alloys in 6M HCl solution," *Material Science and Engineering*, A318, 2001, pp. 77-86.

Murakami (Editor), *Stress Intensity Factors Handbook*, vol. 2, Oxford: Pergamon Press, 1987, 4 pages.

Yokoyama et al., "Viscous Flow Workability of Ni—Cr—P—B Metallic Glasses Produced by Melt-Spinning in Air," *Materials Transactions*, vol. 48, No. 12, 2007, pp. 3176-3180.

U.S. Appl. No. 14/048,894, filed Oct. 8, 2013, Na et al.

U.S. Appl. No. 14/067,521, filed Oct. 30, 2013, Na et al.

U.S. Appl. No. 14/077,830, filed Nov. 12, 2013, Na et al.

U.S. Appl. No. 14/081,622, filed Nov. 15, 2013, Na et al.

U.S. Appl. No. 14/149,035, filed Jan. 7, 2014, Na et al.

(56) References Cited

OTHER PUBLICATIONS

Duan et al., "Thermal and elastic properties of Cu—Zr—Be bulk metallic glass forming alloys," *Applied Physics Letters*, 2007, vol. 90, pp. 211901-1-211901-3.
Laws et al., "Electron-band theory inspired design of magnesium-precious metal bulk metallic glasses with high thermal stability and extended ductility," Scientific Reports, 2017, 7L 3400, 11 pages.
Shamlaye et al., "Exceptionally broad bulk metallic glass formation in the Mg—Cu—Yb system," *Acta Materialia*, 2017, vol. 128, pp. 188-196.
International Preliminary Report on Patentability for International Application No. PCT/US2013/060226, dated Mar. 17, 2015, dated Mar. 26, 2015, 9 Pgs.
International Search Report and Written Opinion for International Application No. PCT/US2013/060226, Search completed Dec. 5, 2013, dated Jun. 11, 2014, 14 Pgs.
Burke, "The Corrosion of Metals in Tissues; and an Introduction to Tantalum", The Canadian Medical Association Journal, Aug. 1940, pp. 125-128.
Geurtsen, "Biocompatibility of Dental Casting Alloys", Crit. Rev. Oral Biol. Med., 2002, vol. 13, No. 1, pp. 71-84.
Greer et al., "Bulk Metallic Glasses: At the Cutting Edge of Metals Research", MRS Bulletin, Aug. 2007, vol. 32, pp. 611-619.
Hiromoto et al., "Effect of chloride ion on the anodic polarization behavior of the Zr65Al7.5Ni10Cu17.5 amorphous alloy in phosphate buffered solution", Corrosion Science, 2000, vol. 42, pp. 1651-1660.
Hiromoto et al., "Effect of pH on the polarization behavior of Zr65Al7.5Ni10Cu17.5 amorphous alloy in a phosphate-buffered solution", Corrosion Science, 2000, vol. 42, pp. 2193-2200.
Inoue, "Stabilization of Metallic Supercooled Liquid and Bulk Amorphous Alloys", Acta Materialia, 2000, vol. 48, pp. 279-306.
Inoue et al., "Preparation of Bulky Amorphous Zr—Al—Co—Ni—Cu Alloys by Copper Mold Casting and Their Thermal and Mechanical Properties", Materials Transactions, JIM, 1995, vol. 36, No. 3, pp. 391-398.
Johnson, "Bulk Glass-Forming Metallic Alloys: Science and Technology", MRS Bulletin, Oct. 1999, pp. 42-56.
Li et al., "Effects of Cu, Fe, and Cu Addition on the Glass Forming Ability and Mechanical Properties of Zr—Al—Ni Bulk Metallic Glasses", Science China, Physics, Mechanics & Astronomy, Dec. 2012, vol. 55, No. 12, pp. 2367-2371.
Morrison et al., "Cyclic-anodic-polarization studies of a Zr41.2Ti13.8Ni10Cu12.5Be22.5 bulk metallic glass", Intermetallics, 2004, vol. 12, pp. 1177-1181.
Murakami, "Stress Intensity Factors Handbook", Oxford: Pergamon Press, 1987, vol. 2, 4 pages.
Peker et al., "A highly processible metallic glass Zr41.2Ti13.8Cu12.5Ni10.0Be22.5", Applied Physics Letters, Oct. 25, 1993, vol. 63, No. 17, pp. 2342-2344.
Schroers, "The Superplastic Forming of Bulk Metallic Glasses", JOM, May 2005, pp. 35-39.
Wang et al., "Fatigue behavior and fracture morphology of Zr50Al10Cu40 and Zr50Al10Cu30Ni10 bulk-metallic glasses", Intermetallics, 2004, vol. 12, pp. 1219-1227.
Yamamoto et al., "Cytotoxicity evaluation of 43 metal salts using murine fibroblasts and osteoblastic cells", Journal of Biomed. Materials Research, 1998, vol. 39, 331-340.
U.S. Appl. No. 14/458,091, filed Aug. 12, 2014, Jong Hyun Na et al.
U.S. Appl. No. 14/501,779, filed Sep. 30, 2014, Jong Hyun Na et al.
U.S. Appl. No. 14/540,815, filed Nov. 13, 2014, Jong Hyun Na et al.
U.S. Appl. No. 14/565,219, filed Dec. 9, 2014, Jong Hyun Na et al.
U.S. Appl. No. 14/581,950, filed Dec. 23, 2014, Jong Hyun Na et al.

* cited by examiner

BULK NICKEL-SILICON-BORON GLASSES BEARING CHROMIUM

CROSS-REFERENCE TO RELATED APPLICATION

The present application claims priority to U.S. Provisional Patent Application No. 61/702,007, entitled "Bulk Nickel-Silicon-Boron Glasses Bearing Chromium", filed on Sep. 17, 2012, and U.S. Provisional Patent Application No. 61/847,961, entitled "Bulk Nickel-Silicon-Boron Glasses Bearing Chromium and Molybdenum", filed on Jul. 18, 2013, both of which are incorporated herein by reference in their entirety.

TECHNICAL FIELD

The present disclosure generally relates to nickel-silicon-boron (Ni—Si—B) alloys capable of forming bulk metallic glasses. More specifically, the disclosure relates to adding chromium (Cr) and/or phosphorus (P) or molybdenum (Mo) to the Ni—Si—B alloy to improve metallic glass-forming ability (GFA).

BACKGROUND

Nickel alloys have been reported that form metallic glasses with diameters below 200 micrometers. For example, Japanese patent JP-08-269647 (1996), entitled "Ni-Based Amorphous Metallic Filament", by Takeshi Masumoto, et al., discloses $Ni_{100-b-c}Si_bB_c$ alloys, where subscripts b and c denote atomic percents for Si and B, respectively, $3<b<17$, and $10<c<27$, that can form amorphous wires with diameters on the order of tens of micrometers via a spinning method in a rotating liquid. The Masumoto et al. reference lists a variety of possible additions, including Fe, Co, Nb, Ta, Mo, V, W, Cr, Mn, Cu, P, C, and germanium, that can be included to improve the tensile strength, heat resistance, and corrosion resistance of the alloys. Although the Masumoto et al., reference does not specifically teach certain ranges for Cr additions, they do disclose that Fe, Co, Nb, Ta, Mo, V, W, Mn, Cu, P, C, Ge as well as Cr could be added to improve the tensile strength, the heat resistance and corrosion resistance of the alloys. The Ni—Si—B alloy of Masumoto contained 13% Cr and is reported to have a casting diameter of only 50 micrometers. Further, the Ni—Si—B alloys or Ni—Cr—Si—B alloys described in the Masumoto et al. reference are generally limited to diameters below 200 micrometers, and the authors describe that "crystalline phases emerge and the processability [of the alloys] worsens when the wires exceed 200 micrometers [in diameter]."

It is thus desirable to develop nickel bulk metallic glasses with greater thicknesses and methods of making the same.

SUMMARY

Embodiments described herein provide Ni—Cr—Si—B, Ni—Cr—S—B—P or Ni—Cr—Mo—Si—B—P alloys that are capable of forming metallic glass rods with diameters of at least 1 mm. Embodiments described herein are further directed to a metallic glass comprising such alloy compositions. The chromium containing alloys Ni—Cr—Si—B or Ni—Cr—Si—B—P have better glass forming ability than Ni—Si—B alloys that do not contain chromium. The phosphorous containing Ni—Cr—Si—B—P alloys have even better glass forming ability than the Ni—Cr—Si—B alloys that do not contain phosphorous. The molybdenum containing Ni—Cr—Mo—Si—B—P alloys have better glass forming ability and higher notch toughness than the Ni—Cr—Si—B—P alloys. Additionally, the metallic glass rods with diameters up to 1 mm can be plastically bent. Embodiments also provide a fluxing method to further improve glass-forming ability for the Ni—Cr—Si—B alloys, the Ni—Cr—Si—B—P alloys, and the Ni—Cr—Mo—Si—B—P alloys.

In one embodiment, an alloy capable of forming a bulk metallic glass is provided. The alloy or the metallic glass has the composition $Ni_{(100-a-b-c)}Cr_aSi_bB_c$, where an atomic percent of chromium (Cr) a is between 3 and 8, an atomic percent of silicon (Si) b is between 10 and 14, an atomic percent of boron (B) c is between 9 and 13, and the balance is Ni, and wherein the alloy is capable of forming a metallic glass rod having a diameter of at least 1 mm.

In another embodiment, an alloy capable of forming bulk metallic glass is provided. The alloy or the metallic glass has the composition $Ni_{(100-a-b-c-d)}Cr_aSi_bB_cP_d$, where an atomic percent of chromium (Cr) a is between 3 and 8, an atomic percent of silicon (Si) b is between 4 and 12, an atomic percent of boron (B) c is between 9 and 13, an atomic percent of phosphorus (P) d is between 0.5 and 8, and the balance is Ni, and wherein the alloy is capable of forming metallic glass rod having a diameter of at least 1 mm.

The disclosure is also directed to an alloy or metallic glass having a composition selected from the group consisting of $Ni_{71.5}Cr_{5.5}Si_{12}B_{11}$, $Ni_{71.5}Cr_{5.5}Si_6B_{12}P_5$, $Ni_{72}Cr_{5.5}Si_{5.75}B_{11.75}P_5$, $Ni_{72}Cr_{5.5}Si_6B_{11.5}P_5$, $Ni_{71.75}Cr_{5.75}Si_{5.75}B_{11.75}P_5$, $Ni_{72}Cr_{5.5}Si_{5.5}B_{11.75}P_{5.25}$, and $Ni_{72.25}Cr_{5.25}Si_{5.75}B_{11.75}P_5$.

In another embodiment, Ni—Cr—Mo—Si—B—P alloys are disclosed capable of forming a metallic glass rod having a diameter of at least or greater than 2 mm, or alternatively at least 3 mm when processed by melt water quenching in fused silica tubes having wall thickness of 0.5 mm.

The disclosure is directed to an alloy capable of forming a bulk metallic glass, the alloy is represented by the following formula (subscripts denote atomic percent):

$$Ni_{(100-a-b-c-d-e)}Cr_aMo_bSi_cB_dP_e \quad (1)$$

where a is between 3.5 and 6, b is up to 2, c is between 4.5 and 7, d is between 10.5 and 13, and e is between 4 and 6.

In another embodiment, c+d+e in Eq. 1 is between 21.5 and 23.5.

In another embodiment, a+b in Eq. 1 is between 4.5 and 6.5 while b is between 0.25 and 1.5.

In another embodiment, a+b in Eq. 1 is between 5 and 6 while b is between 0.5 and 1.25, and wherein the metallic glass rod diameter when processed by water quenching the high temperature melt in a fused silica tube having wall thickness of 0.5 mm is at least 2.5 mm.

In yet another embodiment, up to 2 atomic percent of Ni is substituted by Fe, Co, W, Mn, Ru, Re, Cu, Pd, Pt, or combinations thereof.

In yet another embodiment, the melt is fluxed with a reducing agent prior to rapid quenching.

In yet another embodiment, the melt temperature prior to quenching is at least 200° C. above the liquidus temperature of the alloy.

In yet another embodiment, the melt temperature prior to quenching is at least 1200° C.

In yet another embodiment, the compressive yield strength is at least 2600 MPa.

In yet another embodiment, a wire made of such glass having a diameter of 1 mm can undergo macroscopic plastic deformation under bending load without fracturing catastrophically.

The disclosure is also directed to an alloy capable of forming a metallic glass having a composition selected from the group consisting of $Ni_{72}Cr_5Mo_{0.5}Si_{5.75}B_{11.75}P_5$, $Ni_{72}Cr_{4.75}Mo_{0.75}Si_{5.75}B_{11.75}P_5$, $Ni_{72}Cr_{4.5}Mo_1Si_{5.75}B_{11.75}P_5$, $Ni_{72}Cr_{4.25}Mo_{1.25}Si_{5.75}B_{11.75}P_5$, and $Ni_{72}Cr_4Mo_{1.5}Si_{5.75}B_{11.75}P_5$.

In another embodiment, the disclosure is also directed to a metallic glass represented by formula $Ni_{(100-a-b-c-d-e)}Cr_aMo_bSi_cB_dP_e$, wherein subscripts a, b, c, d, and e denote atomic percents for Cr, Mo, Si, B and P, a is between 3.5 and 6, b is up to 2, c is between 4.5 and 7, d is between 10.5 and 13, e is between 4 and 6, and the balance is Ni. In some embodiments, the metallic glass rod diameter that can form when processed by water quenching the high temperature melt in a fused silica tube having wall thickness of 0.5 mm is at least 2 mm. In some embodiments, the stress intensity at crack initiation of the metallic glass when measured on a 2 mm diameter metallic glass rod containing a notch with length between 0.75 and 1.25 mm and root radius between 0.1 and 0.15 mm is at least 55 MPa $m^{1/2}$.

In another embodiment, the disclosure is also directed to a metallic glass having a composition selected from the group consisting of $Ni_{72}Cr_5Mo_{0.5}Si_{5.75}B_{11.75}P_5$, $Ni_{72}Cr_{4.75}Mo_{0.75}Si_{5.75}B_{11.75}P_5$, $Ni_{72}Cr_{4.5}Mo_1Si_{5.75}B_{11.75}P_5$, $Ni_{72}Cr_{4.25}Mo_{1.25}Si_{5.75}B_{11.75}P_5$, and $Ni_{72}Cr_4Mo_{1.5}Si_{5.75}B_{11.75}P_5$.

In a further embodiment, a method is provided for forming a bulk metallic glass. The method includes melting an alloy described herein into a molten state, and quenching the molten alloy at a cooling rate sufficiently rapid to prevent crystallization of the alloy. The method also can include a step of fluxing of the molten alloy prior to quenching using a reducing agent to improve the glass-forming ability.

Additional embodiments and features are set forth in part in the description that follows, and in part will become apparent to those skilled in the art upon examination of the specification or may be learned by the practice of the disclosure. A further understanding of the nature and advantages of the present disclosure may be realized by reference to the remaining portions of the specification and the drawings, which forms a part of this disclosure.

Figure 1:
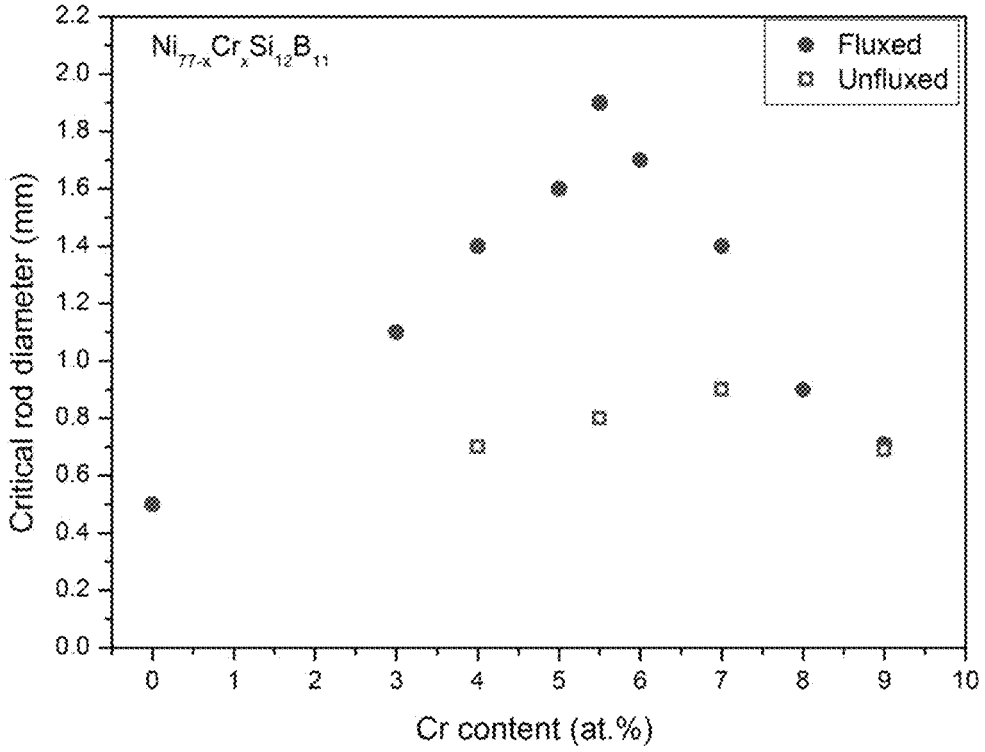
FIG. 1 provides a data plot showing the effect of substituting Ni by Cr on the glass-forming ability of Ni—Cr—Si—B alloys according to embodiments of the present disclosure.

Reference is now made to certain embodiments. The disclosed embodiments are not intended to be limiting of any claim supported by this disclosure. To the contrary, the appended claims are intended to cover all alternatives, modifications, and equivalents.

DETAILED DESCRIPTION

The present disclosure may be understood by reference to the following detailed description, taken in conjunction with the drawings as described below. It is noted that, for purposes of illustrative clarity, certain elements in various drawings may not be drawn to scale.

The present disclosure provides Ni—Cr—Si—B, Ni—Cr—Si—B—P, and Ni—Cr—Mo—Si—B—P alloys capable of forming bulk metallic glasses. By controlling the relative concentrations of Ni, Si, and B, and by incorporating minority additions of Cr to substitute Ni, the alloy has better glass forming ability than Ni—Si—B alloys. By incorporating P to substitute Si in the Ni—Cr—Si—B alloys, the alloys are capable of forming a metallic glass rods having diameters of at least 1 mm, and up to 2.5 mm or greater. By incorporating Mo to substitute Cr in the Ni—Cr—Si—B—P, the alloys are capable of forming metallic glass rods having diameters of up to 3 mm or greater.

As described in the "Background", alloys incorporating a combination of Ni—Cr—Si—B have been disclosed in the past, but they have not shown bulk processability. In general, the glass-forming ability of each alloy may be assessed by determining the maximum or "critical" rod diameter in which the amorphous phase can be formed when processed by a method of water quenching a molten alloy described herein. Water quenching of the molten alloy may be performed in quartz capillaries or tubes. Since quartz is known to be a poor heat conductor that retards heat transfer, the quartz thickness is a critical parameter associated with the glass-forming ability of the sample alloys. Therefore, to quantify the glass-forming ability of each of the sample alloys, the critical rod diameter, $d_c$, is reported in conjunction with the associated quartz thickness, $t_w$, of the capillary or tube used to process the alloy.

In the present disclosure, it has been discovered that the addition of Cr in a very specific range promotes bulk-glass formation in Ni—Si—B alloys. In particular, the present alloys include Cr between 1% and 10% (atomic percent), with a peak around 5.5%. This low Cr content runs contrary to Masumoto (JP-08-269647). Masumoto allows, and provides an example of, Cr exceeding 10%.

It has also been discovered that glass formation may be further promoted by the addition of phosphorus (P) to the Ni—Cr—Si—B alloy, a possibility not disclosed by Masumoto. In particular, Ni—Cr—Si—B—P alloys that include P in the range of 1% to 8% may have better glass-forming ability than P-free Ni—Cr—Si—B alloys.

It has further been discovered that when up to 2 atomic percent Mo is added to Ni—Cr—Si—B—P alloys to substitute Cr, the glass forming ability of the alloys is further enhanced. In such instances, the alloy is capable of forming metallic glass rods having diameters of up to 3 mm or greater. In addition, such alloys can have a notch toughness that increases from under 50 MPa $m^{1/2}$ for the Mo-free metallic glasses to at least 65 MPa $m^{1/2}$ for the Mo-bearing metallic glasses. In an example of the present disclosure, the Ni—Cr—Mo—Si—B—P composition includes (in atomic percent) about 4.5 to 5% Cr, about 0.5 to 1% Mo, about 5.75% Si, about 11.75% B, about 5 atomic percent of P, and the balance is Ni.

Furthermore, the present disclosure provides a fluxing process to improve glass-forming ability even further. Fluxing is a chemical process by which the fluxing agent acts to "reduce" the oxides entrained in the glass-forming alloy that could potentially impair glass formation by catalyzing crystallization. The benefits of fluxing in promoting glass formation are determined by the chemistry of the alloy, the entrained oxide inclusions, and the fluxing agent. It has now been discovered that for the Ni—Si—B alloys claimed in the instant disclosure, fluxing with boron oxide ($B_2O_3$) dramatically improves bulk-glass formation.

Ni—Cr—Si—B Alloys and Metallic Glasses

In one aspect, the alloy or metallic glass (i.e. alloy in amorphous form) is represented by the following formula:

$$Ni_{(100-a-b-c)}Cr_aSi_bB_c \quad (2)$$

where subscripts a, b, and c denote atomic percents for Cr, Si, and B, respectively. An atomic percent of Cr is between 3 and 8, an atomic percent of Si is between 10 and 14, an atomic percent of B is between 9 and 13, and the balance is Ni. The alloy is capable of forming a metallic glass rod having a diameter of at least 1 mm. In a particular embodiment, a combined atomic percent of Si and B is between 21 and 24. In another particular embodiment, an atomic percent of Cr is between 4.5 and 6.5. In a further particular embodiment, up to 2 atomic percent of Cr is substituted by Fe, Co, Mn, W, Mo, Ru, Re, Cu, Pd, Pt, Nb, V, Ta, or combinations thereof. In yet another particular embodiment, up to 2 atomic percent of Ni is substituted by Fe, Co, Mn, W, Mo, Ru, Re, Cu, Pd, Pt, Nb, V, Ta, or combinations thereof. In yet another particular embodiment, the alloy or the metallic glass has composition $Ni_{71.5}Cr_{5.5}Si_{12}B_{11}$.

Sample alloys that satisfy the disclosed formula shown in Eq. (2) are presented in Table 1. In the sample metallic glasses described in Table 1, the Si content is 12 atomic percent and the B content is 11 atomic percent for samples 1-9, while in sample metallic glasses 1-9 the Cr and Ni contents are varied. For some samples, such as 3, 5, 7, and 9, the critical rod diameter of metallic glasses produced with or without the fluxing is presented. For the remaining samples, such as Samples 1-2, 4, 6, and 8, only the critical rod diameter of the metallic glasses produced with fluxing is presented.

TABLE 1

Sample metallic glasses Ni—Cr—Si—B and glass-forming ability of alloys

| Sample | Composition [at %] | Fluxed/Unfluxed | $d_c$ [mm] | $t_w$ [mm] |
|---|---|---|---|---|
| 1 | $Ni_{77}Si_{12}B_{11}$ | Fluxed | 0.5 | 0.05 |
| 2 | $Ni_{74}Cr_3Si_{12}B_{11}$ | Fluxed | 1.1 | 0.11 |
| 3 | $Ni_{73}Cr_4Si_{12}B_{11}$ | Fluxed | 1.4 | 0.14 |
| | | Unfluxed | 0.7 | 0.07 |
| 4 | $Ni_{72}Cr_5Si_{12}B_{11}$ | Fluxed | 1.6 | 0.16 |
| 5 | $Ni_{71.5}Cr_{5.5}Si_{12}B_{11}$ | Fluxed | 1.9 | 0.19 |
| | | Unfluxed | 0.8 | 0.08 |
| 6 | $Ni_{71}Cr_6Si_{12}B_{11}$ | Fluxed | 1.7 | 0.17 |
| 7 | $Ni_{70}Cr_7Si_{12}B_{11}$ | Fluxed | 1.4 | 0.14 |
| | | Unfluxed | 0.9 | 0.09 |
| 8 | $Ni_{69}Cr_8Si_{12}B_{11}$ | Fluxed | 0.9 | 0.09 |
| 9 | $Ni_{68}Cr_9Si_{12}B_{11}$ | Fluxed | 0.7 | 0.07 |
| | | Unfluxed | 0.7 | 0.07 |

At a first stage of experiments, quartz capillaries with wall thicknesses that were about 10% of the tube inner diameter were used for processing the alloys to form the sample metallic glasses. A ternary eutectic in the ternary Ni—Si—B alloy was identified at composition $Ni_{77}Si_{12}B_{11}$. When fluxed with $B_2O_3$ and processed in a capillary with a 0.05 mm thick wall, the ternary alloy was found capable of forming 0.5 mm diameter metallic glass rods.

FIG. 1 provides a data plot of the critical rod diameter for samples 1-9 in Table 1 showing the effect of substituting Ni by Cr on the glass-forming ability of Ni—Cr—Si—B alloys according to the formula $Ni_{77-x}Cr_xSi_{12}B_{11}$. As shown in FIG. 1, substituting Ni by Cr in the range between 3% and 8% was found to significantly improve metallic glass formation over the alloy without any Cr, as metallic glass rods of 1 mm or larger can be produced when fluxed with $B_2O_3$. The alloy having composition $Ni_{71.5}Cr_{5.5}Si_{12}B_{11}$ (sample 5) corresponding to 5.5% Cr substitution exhibits the highest glass forming ability, being able to form metallic glass rods of nearly 2 mm when the quartz capillary wall thickness is about 0.2 mm.

Without any Cr, the rod diameter is about 0.5 mm when fluxed, much smaller than the 2 mm with 5.5% Cr. With the Cr content increasing from 5.5 to 9 atomic percent, the glass-forming ability is reduced to the levels of the Cr-free alloy. As shown, the Ni—Cr—Si—B alloy was found to reveal bulk glass-forming ability within a limited range of Cr.

As shown in FIG. 1, the alloys having the same composition but being fluxed (represented by solid circles) were found to have better glass-forming ability than the unfluxed (represented by open squares) over the range of Cr between 1 and 10 atomic percent. For example, the $Ni_{71.5}Cr_{5.5}Si_{12}B_{11}$ alloy has a critical rod diameter of about 2 mm when fluxed, but only about 0.8 mm if unfluxed. Outside that range the effect of fluxing on improving glass forming ability diminishes. As shown in FIG. 1, the alloy with 9% of Cr has a critical rod diameter of about 0.7 mm whether fluxed or unfluxed.

Figure 2:
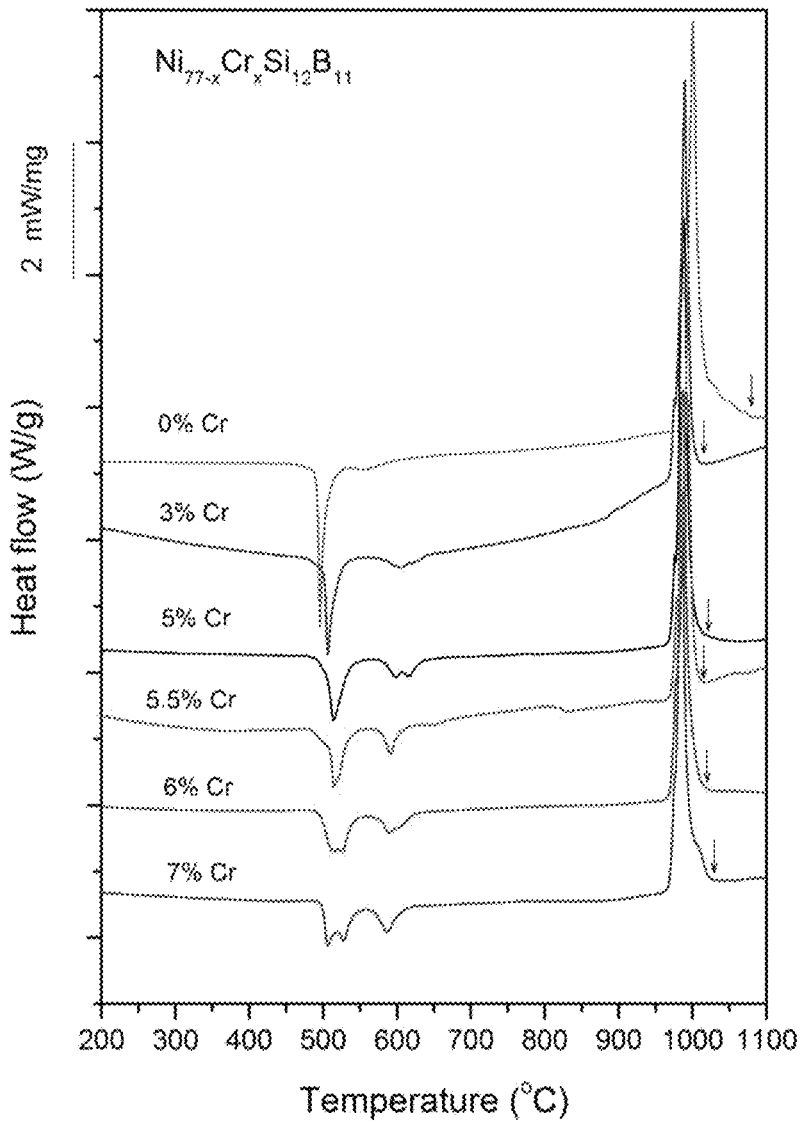
FIG. 2 provides calorimetry scans for sample Ni—Cr—Si—B metallic glasses with varying Cr atomic concentrations shown in Table 1 according to embodiments of the present disclosure.

FIG. 2 provides calorimetry scans for Ni—Cr—Si—B metallic glasses having varying Cr atomic concentrations shown in Table 1 according to embodiments of the present disclosure. The arrows designate the liquidus temperatures of the alloys. From the calorimetry scans, it is evident that the Ni—Cr—Si—B alloys have lower liquidus temperatures as compared to those of the ternary Ni—Si—B alloys, with a minimum liquidus temperature occurring around the Cr addition of 5.5%. Lower liquidus temperatures are desirable, as it implies an improved potential for glass formation.

Ni—Cr—Si—B—P Alloys and Metallic Glasses

In another aspect, the alloy or metallic glass (i.e. the alloy in the amorphous phase) is represented by the following formula:

$$Ni_{(100-a-b-c-d)}Cr_aSi_bB_cP_d \quad (3)$$

where subscripts a, b, c and d denote atomic percents for Cr, Si, B, and P, respectively, an atomic percent of chromium (Cr) a is between 3 and 8, an atomic percent of silicon (Si) b is between 4 and 12, an atomic percent of boron (B) c is between 9 and 13, an atomic percent of phosphorus (P) d is between 0.5 and 8, and the balance is Ni.

In a particular embodiment, a combined atomic percent of Si, B and P, i.e. b, c, and d is between 21 and 24. In another particular embodiment, the atomic percent of Cr is between 4.5 and 6.5. In a further particular embodiment, up to 2 atomic percent of Cr is substituted by iron (Fe), Cobalt (Co), Manganese (Mn), Tungsten (W), Molybdenum (Mo), Ruthenium (Ru), Rhenium (Re), Copper (Cu), Palladium (Pd), Platinum (Pt), Niobium (Nb), Vanadium (V), Tantalum (Ta), or combinations thereof. In yet another particular embodiment, up to 2 atomic percent of Ni is substituted by Fe, Co, Mn, W, Mo, Ru, Re, Cu, Pd, Pt, Nb, V, Ta, or combinations thereof. In yet another embodiment, the metallic glasses or alloy compositions include $Ni_{71.5}Cr_{5.5}Si_6B_{12}P_5$, $Ni_{72}Cr_{5.5}Si_{5.75}B_{11.75}P_5$, $Ni_{72}Cr_{5.5}Si_6B_{11.5}P_5$, $Ni_{71.75}Cr_{5.75}Si_{5.75}B_{11.75}P_5$, $Ni_{72}Cr_{5.5}Si_{5.5}B_{11.75}P_{5.25}$, and $Ni_{72.25}Cr_{5.25}$, $Si_{5.75}B_{11.75}P_5$.

Sample alloys or metallic glasses with compositions satisfying Eq. (3) are presented in Table 2. The atomic percent of Cr varies between 5% and 6% for samples 10-34, which is around the content of 5.5% that reveals the highest glass-forming ability among all the alloys investigated. The atomic percent of B also varies between 11% and 12.5%. The atomic percent of P also varies between 4% and 6%. The combined atomic percent of Si, B, and P remains a constant of 23% for samples 10-19, but varies between approximately 21% and 24% for samples 20-34.

The quartz tubes have relatively thicker wall thickness compared to those in Table 1, ranging from about 0.2 mm to 0.5 mm. The Ni—Cr—Si—B—P alloys in Table 2 have better glass forming ability than the Ni—Cr—Si—B shown in Table 1, as bulk metallic glass rods are being produced in quartz tubes with thicker walls.

TABLE 2

Sample metallic glasses Ni—Cr—Si—B—P and glass-forming ability of alloys

| Sample | Composition [%] | Fluxed/Unfluxed | $d_c$ [mm] | $t_w$ [mm] |
|---|---|---|---|---|
| 10 | $Ni_{71}Cr_6Si_{10}B_{11}P_2$ | Fluxed | 2.1 | 0.21 |
| 11 | $Ni_{71}Cr_6Si_8B_{11}P_4$ | Fluxed | 2.5 | 0.25 |
| 12 | $Ni_{71}Cr_6Si_7B_{11}P_5$ | Fluxed | 3.2 | 0.32 |
| 13 | $Ni_{71}Cr_6Si_6B_{11}P_6$ | Fluxed | 2.5 | 0.25 |
| 14 | $Ni_{71}Cr_6Si_9B_{10}P_4$ | Fluxed | 2.1 | 0.21 |
| 15 | $Ni_{71}Cr_6Si_7B_{12}P_4$ | Fluxed | 2.8 | 0.28 |
| 16 | $Ni_{71}Cr_6Si_{6.5}B_{12.5}P_4$ | Fluxed | 2.9 | 0.29 |
| 17 | $Ni_{71}Cr_6Si_6B_{13}P_4$ | Fluxed | 2.8 | 0.28 |
| 18 | $Ni_{71}Cr_6Si_5B_{14}P_4$ | Fluxed | 1.6 | 0.16 |
| 19 | $Ni_{73}Cr_6Si_6B_{11}P_4$ | Fluxed | 1.7 | 0.17 |
| 20 | $Ni_{72}Cr_6Si_{6.5}B_{11.5}P_4$ | Fluxed | 2.8 | 0.28 |
| 21 | $Ni_{71.5}Cr_6Si_{6.75}B_{11.75}P_4$ | Fluxed | 3.1 | 0.31 |
| 22 | $Ni_{70}Cr_6Si_{7.5}B_{12.5}P_4$ | Fluxed | 2.0 | 0.2 |
| 23 | $Ni_{72}Cr_5Si_7B_{12}P_4$ | Fluxed | 2.9 | 0.29 |
| 24 | $Ni_{71.5}Cr_{5.5}Si_7B_{12}P_4$ | Fluxed | 3.4 | 0.34 |
| 25 | $Ni_{70}Cr_7Si_7B_{12}P_4$ | Fluxed | 2.8 | 0.28 |
| 26 | $Ni_{72}Cr_{5.5}Si_{5.25}B_{12.25}P_5$ | Fluxed | 3.0 | 0.30 |
| 27 | $Ni_{72}Cr_{5.5}Si_{5.5}B_{12}P_5$ | Fluxed | 2.7 | 0.27 |
| 28 | $Ni_{72}Cr_{5.5}Si_6B_{11.75}P_{4.75}$ | Fluxed | 2.9 | 0.29 |
| 29 | $Ni_{71.5}Cr_{5.5}Si_6B_{12}P_5$ | Fluxed | 2.5 | 0.5 |
| 30 | $Ni_{72}Cr_{5.5}Si_{5.75}B_{11.75}P_5$ | Fluxed | 2.5 | 0.5 |
| 31 | $Ni_{72}Cr_{5.5}Si_6B_{11.5}P_5$ | Fluxed | 2.5 | 0.5 |
| 32 | $Ni_{71.75}Cr_{5.75}Si_{5.75}B_{11.75}P_5$ | Fluxed | 2.5 | 0.5 |
| 33 | $Ni_{72}Cr_{5.5}Si_{5.5}B_{11.75}P_{5.25}$ | Fluxed | 2.5 | 0.5 |
| 34 | $Ni_{72.25}Cr_{5.25}Si_{5.75}B_{11.75}P_5$ | Fluxed | 2.5 | 0.5 |

Figure 3:
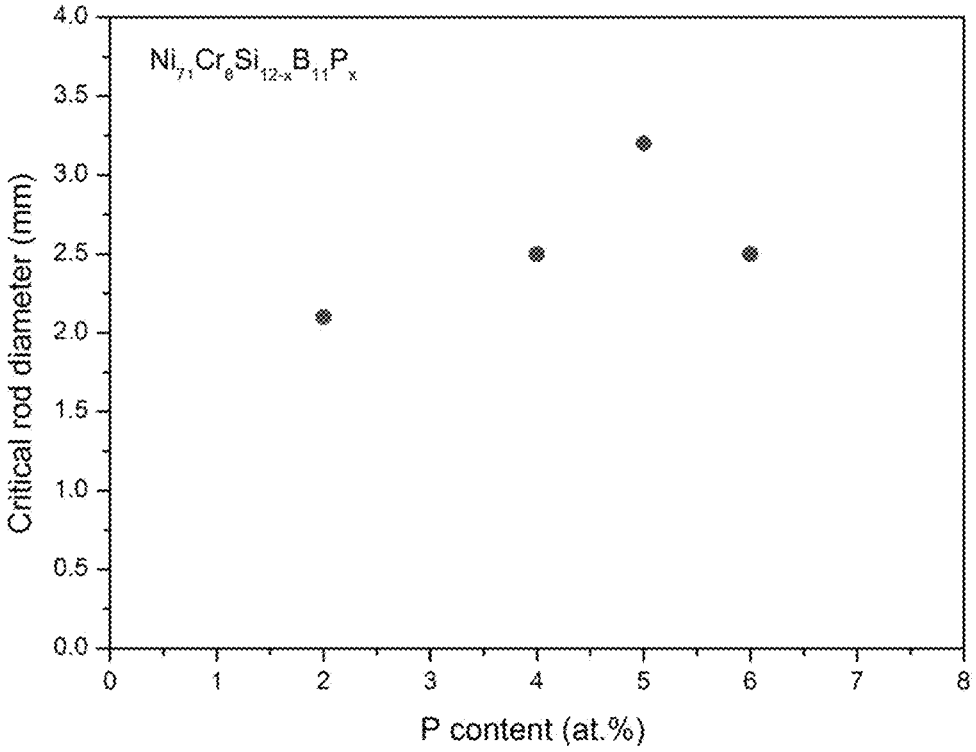
FIG. 3 provides a data plot showing the effect of substituting Si by P on the glass-forming ability of the Ni—Cr—Si—B—P alloy according to embodiments of the present disclosure.

FIG. 3 provides a data plot of the critical rod diameter for samples 10-13 presented in Table 2 showing the effect of P atomic concentration on the glass-forming ability of the Ni—Cr—Si—B—P alloys according to the formula $Ni_{71}Cr_6Si_{12-x}B_{11}P_x$. By substituting Si by P in the quaternary alloy Ni—Cr—Si—B, the glass-forming ability was found to further improve. As shown in FIG. 3, the critical rod diameter reaches a peak at about 5% P, wherein the alloy is able to form metallic glass rods of 3.2 mm in diameter when the quartz capillary wall thickness is about 0.32 mm.

Figure 4:
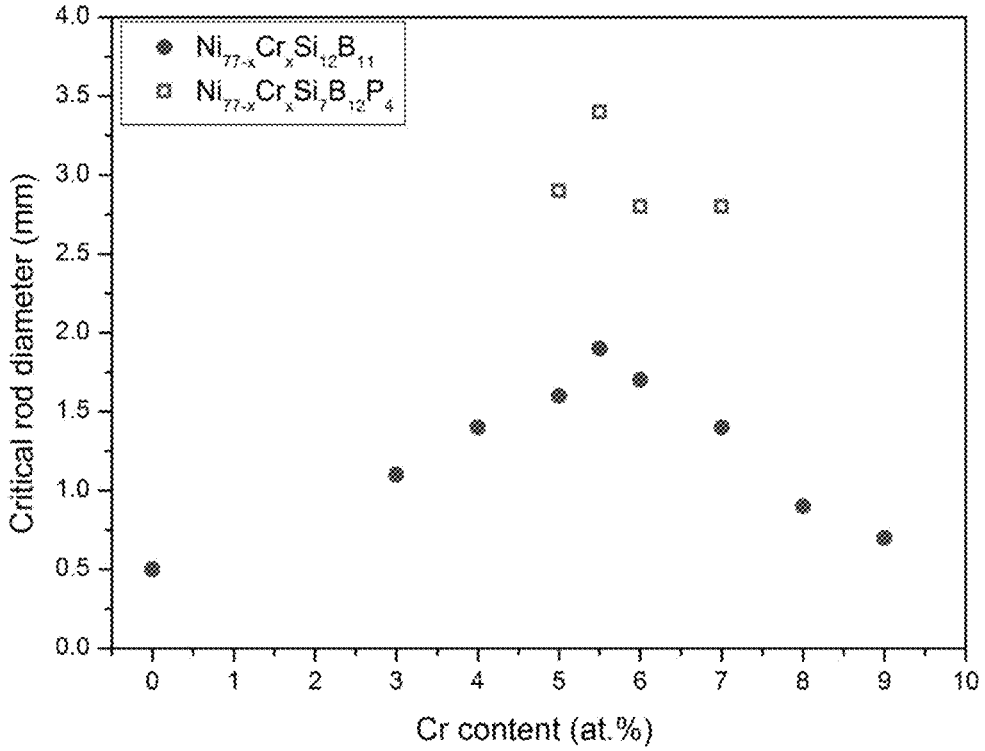
FIG. 4 provides a data plot showing the effect of substituting Ni by Cr on the glass-forming ability of sample Ni—Cr—Si—B and Ni—Cr—Si—B—P alloys according to embodiments of the present disclosure.

FIG. 4 provides a data plot of the critical rod diameter for samples 1-9 in Table 1, and samples 15 and 23-25 in Table 2 showing the effect of Cr atomic concentration on the glass-forming ability of sample Ni—Cr—Si—B and Ni—Cr—Si—B—P alloys according to the formulas $Ni_{77-x}Cr_xSi_{12}B_{11}$ and $Ni_{77-x}Cr_xSi_7B_{12}P_4$, respectively. As shown in FIG. 4, alloys containing 4% P demonstrate considerably better glass-forming ability compared to P-free Ni—Cr—Si—B alloys over a broad Cr range. For example, at 5.5% Cr, alloy $Ni_{71.5}Cr_{5.5}Si_7B_{12}P_4$ (sample 24) has critical rod diameter of about 3.5 mm when the quartz capillary wall thickness is about 0.35 mm, while the P-free $Ni_{71.5}Cr_{5.5}Si_{12}B_{11}$ alloy (sample 5) has critical rod diameter of about 2 mm when the quartz capillary wall thickness is about 0.2 mm.

Figure 5:
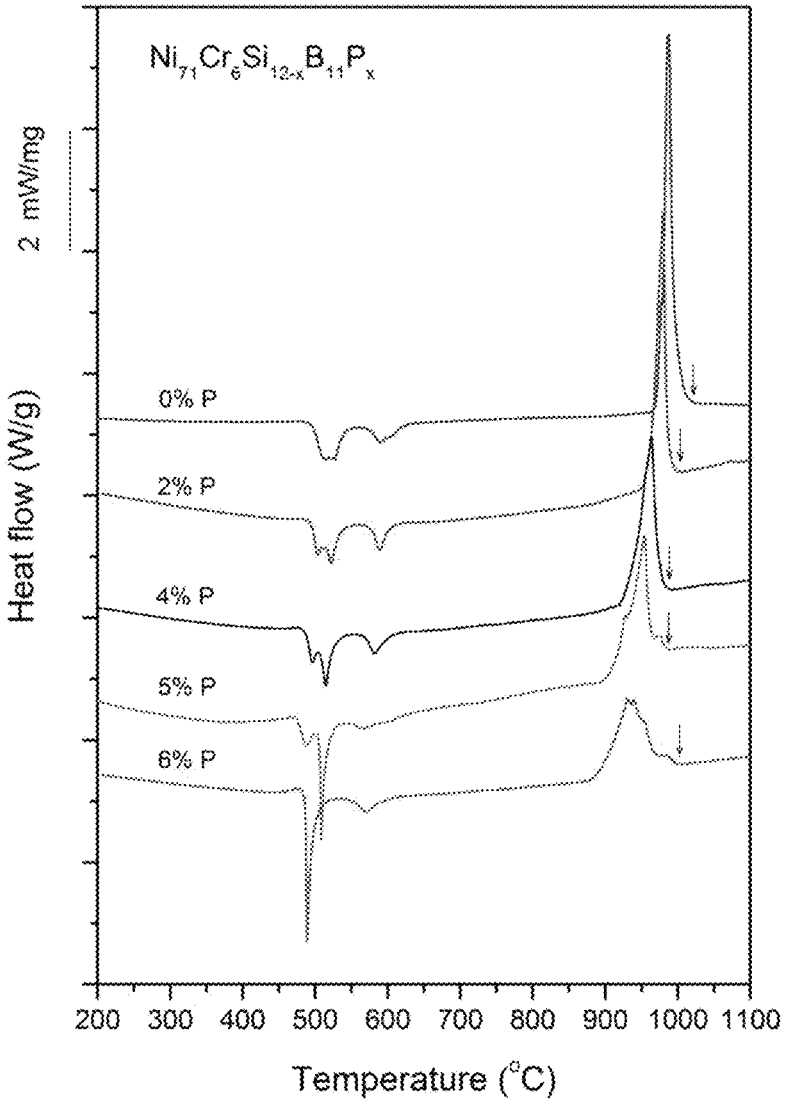
FIG. 5 provides calorimetry scans for sample Ni—Cr—Si—B—P metallic glasses with varying P atomic concentrations shown in Table 2 according to embodiments of the present disclosure.

FIG. 5 provides calorimetry scans for sample metallic glasses Ni—Cr—Si—B—P with varying P atomic concentrations (sample 6 in Table 1 and samples 10-13 in Table 2) according to embodiments of the present disclosure. As shown, the Ni—Cr—Si—B—P alloys have lower liquidus temperatures than the Ni—Cr—S—B alloys, with a minimum occurring around the P content of 5%. Arrows in FIG.

5 designate the liquidus temperatures for the alloys with various contents of P. Lower liquidus temperature as illustrated in the calorimetry scan implies an improved potential for glass forming ability.

Figure 6:
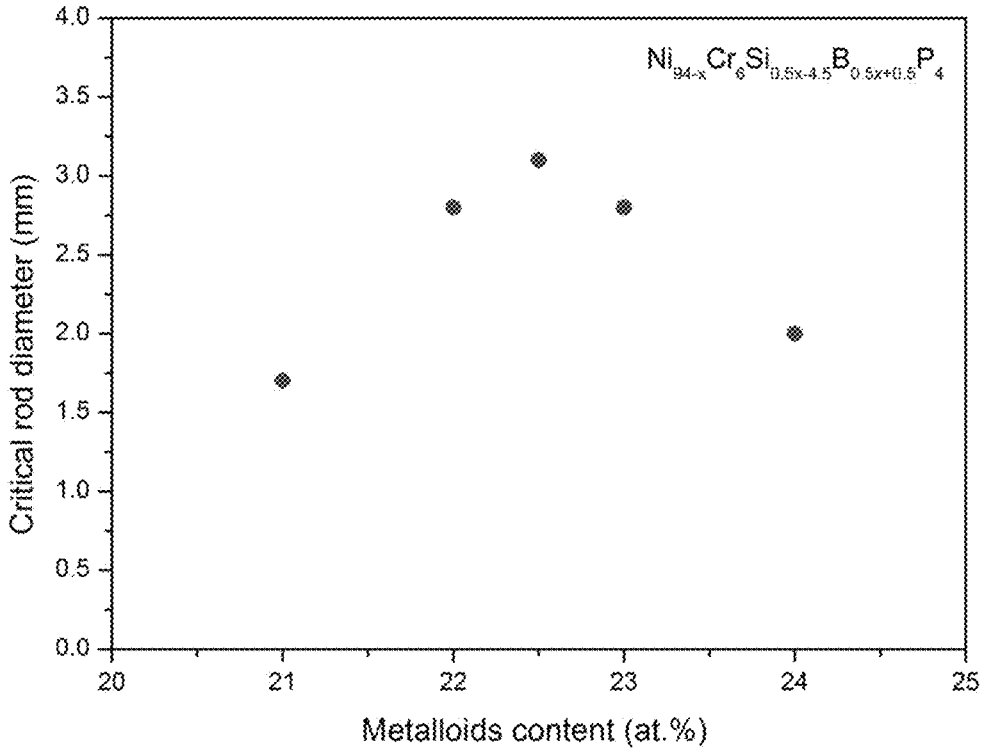
FIG. 6 provides data plots showing the effect of varying the metalloid atomic concentration with the metal atomic concentration on the glass-forming ability of sample Ni—Cr—Si—B—P alloys.

FIG. 6 provides data plots of the critical rod diameter for samples 17 and 19-22 in Table 2 showing the effect of varying the combined Si and B atomic concentration with the Ni atomic concentration on the glass-forming ability of sample Ni—Cr—Si—B—P alloys, according to the formula $Ni_{94-x}Cr_6Si_{0.5x-4.5}B_{0.5x+0.5}P_4$. Varying the total metalloid concentration (the sum of Si, B, and P concentrations) reveals a peak in glass-forming ability at the metalloid concentration of 22.5% (sample 21), as shown in FIG. 6. The critical rod diameter varies from 1.75 mm to about 3 mm in a range of metalloid concentration from 21 to 24 atomic percent, revealing a peak at a metalloid concentration of about 22.5 atomic percent.

Figure 7:
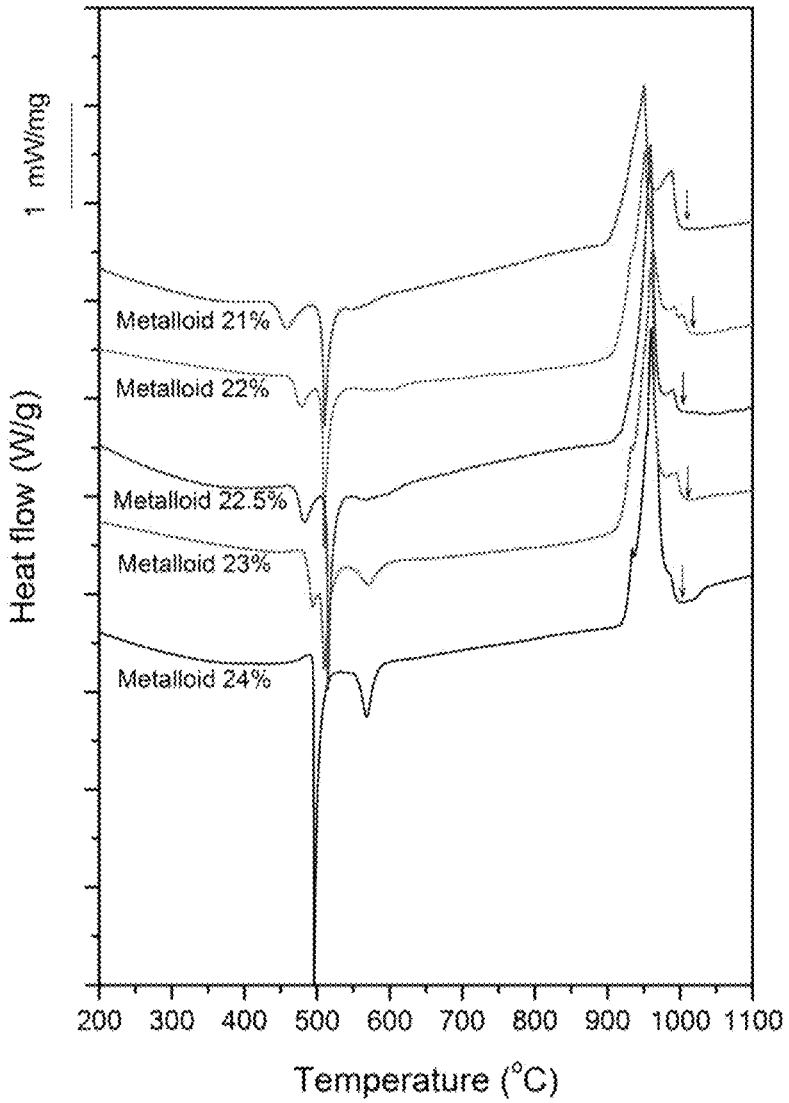
FIG. 7 provides calorimetry scans for sample Ni—Cr—Si—B—P metallic glasses with varying metalloid atomic concentrations shown in Table 2 according to embodiments of the present disclosure.

FIG. 7 provides calorimetry scans for sample metallic glasses Ni—Cr—Si—B—P with varying metalloid atomic concentrations (samples 17 and 19-22 shown in Table 2) according to embodiments of the present disclosure. Again, the arrows designate the liquidus temperatures. The liquidus temperature is seen to undergo through a slight minimum at the metalloid concentration of 22.5%, where the largest glass forming ability is observed according to FIG. 6.

In a more refined stage of the experiments, the Ni—Cr—Si—B—P alloys were processed in quartz tubes having 0.5 mm thick walls. As shown in Table 2, six alloys (Samples 29-34) were capable of forming metallic glass rods at least 2.5 mm in diameter when processed in quartz tubes with 0.5 mm walls. These six alloys are better glass formers than the rest of the alloy family because the 2.5 mm rods are formed using quartz tubes having considerably thicker walls (0.5 mm). The alloy having composition $Ni_{72}Cr_{5.5}Si_{5.75}B_{11.75}P_5$ (Sample 30) is identified as slightly better than the other five as the 2.5 mm rod was found to contain the amorphous phase across the entire rod length, while for the rest of the alloys the amorphous phase was found mostly at the front end of the rod.

Figure 8:
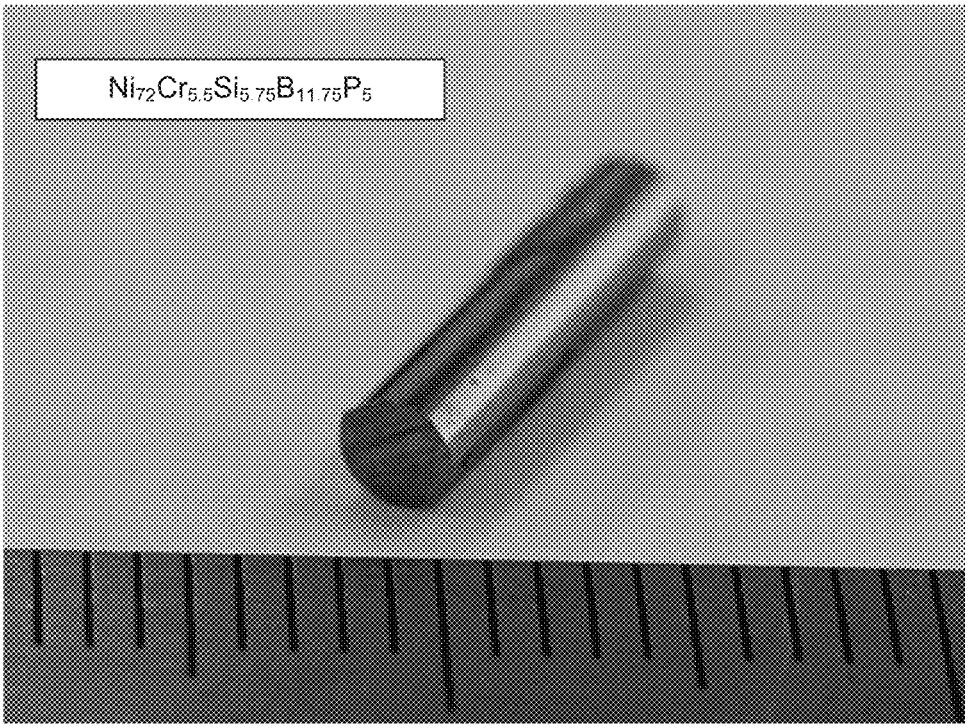
FIG. 8 provides an optical image of a 2.5 mm metallic glass rod having composition $Ni_{72}Cr_{5.5}Si_{5.75}B_{11.75}P_5$ according to embodiments of the present disclosure.

FIG. 8 provides an optical image of a 2.5 mm metallic glass rod of sample metallic glass $Ni_{72}Cr_{5.5}Si_{5.75}B_{11.75}P_5$ (sample 30 in Table 2).

Figure 9:
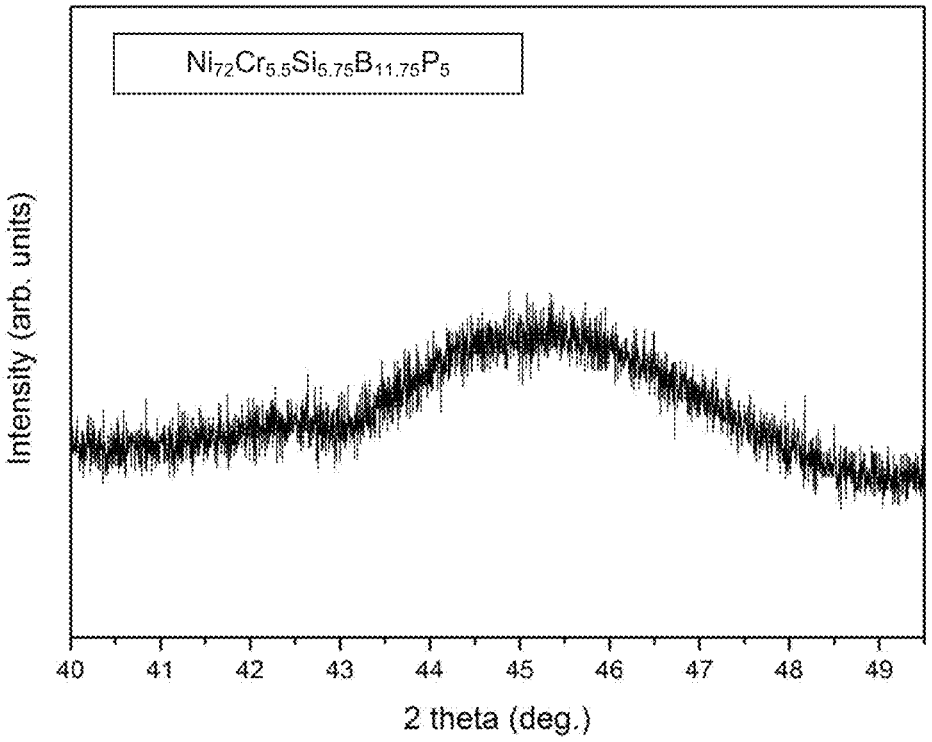
FIG. 9 provides an X-ray diffractogram verifying the amorphous structure of a 2.5 mm metallic glass rod having composition $Ni_{72}Cr_{5.5}Si_{5.75}B_{11.75}P_5$ according to embodiments of the present disclosure FIG. 10 provides a differential calorimetry scan of sample metallic glass $Ni_{72}Cr_{5.5}Si_{5.75}B_{11.75}P_5$.

FIG. 9 provides an X-ray diffractogram verifying the amorphous structure of a 2.5 mm metallic glass rod having composition $Ni_{72}Cr_{5.5}Si_{5.75}B_{11.75}P_5$.

Figure 10:
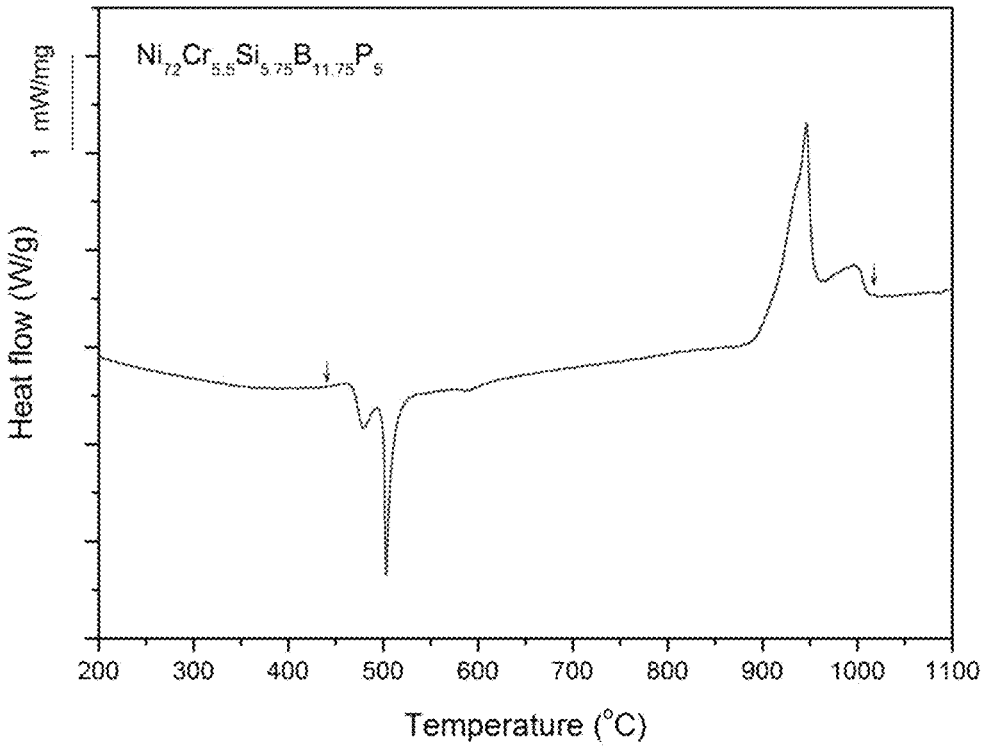

FIG. 10 provides a differential calorimetry scan of a sample metallic glass $Ni_{72}Cr_{5.5}Si_{5.75}B_{11.75}P_5$ showing the glass transition temperature of the metallic glass of 431° C. and the liquidus temperature of the alloy of 1013° C., which are designated by arrows.

Figure 11:
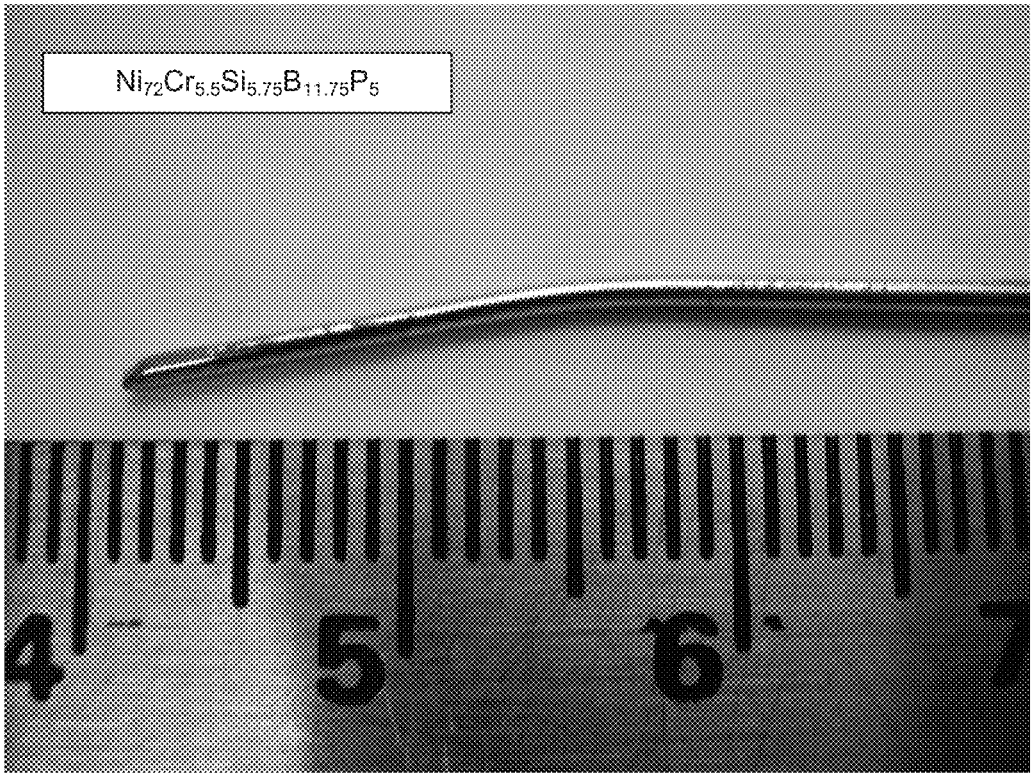
FIG. 11 provides an optical image of a plastically bent 1 mm metallic glass rod having composition $Ni_{72}Cr_{5.5}Si_6B_{11.75}P_{4.75}$ according to embodiments of the present disclosure.

The metallic glasses Ni—Cr—Si—B or Ni—Cr—Si—B—P were also found to exhibit a remarkable bending ductility. Specifically, under an applied bending load, the disclosed alloys are capable of undergoing plastic bending in the absence of fracture for diameters up to 1 mm. FIG. 11 provides an optical image of a plastically bent 1 mm amorphous rod of metallic glass $Ni_{72}Cr_{5.5}Si_6B_{11.75}P_{4.75}$ (sample 28 in Table 2).

Ni—Cr—Mo—Si—B—P Alloys and Metallic Glasses

The alloy composition $Ni_{72}Cr_{5.5}Si_{5.75}B_{11.75}P_5$ (sample 30) was found capable of forming bulk metallic glass rods with diameters of up to 2.5 mm when processed by water quenching the molten metal contained in a fused silica tube having 0.5 mm wall thickness. The notch toughness of this metallic glass when measured on a 2 mm diameter rod containing a notch with length between 0.75 and 1.25 mm and root radius between 0.1 and 0.15 mm, was just under 50 MPa $m^{1/2}$. Discovering alloying additions that simultaneously improve both the glass-forming ability and toughness of the alloys would be of great technological importance.

In a further aspect, the alloy or metallic glass is represented by the following formula:

$$Ni_{(100-a-b-c-d-e)}Cr_aMo_bSi_cB_dP_e \quad (1)$$

where subscript a is between 3.5 and 6, b is up to 2, c is between 4.5 and 7, d is between 10.5 and 13, and e is between 4 and 6 (subscripts indicate atomic percent).

Figure 12:
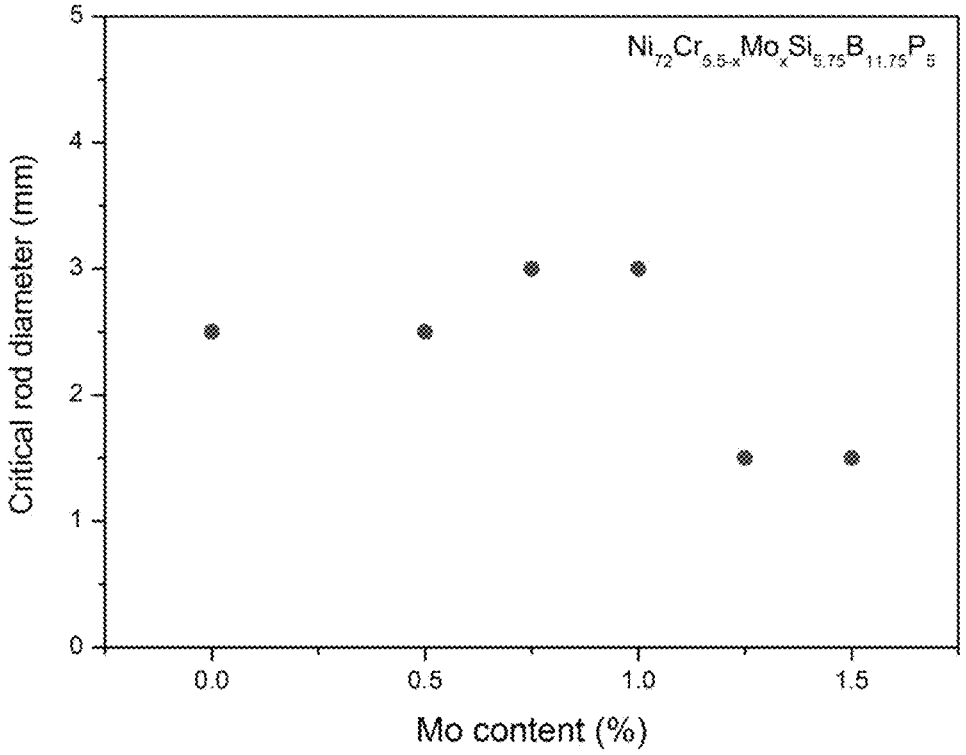
FIG. 12 provides a plot showing the effect of substituting Cr by Mo on the glass forming ability of alloys having compositions $Ni_{72}Cr_{5.5-x}Mo_xSi_{5.75}B_{11.75}P_5$.
Figure 13:
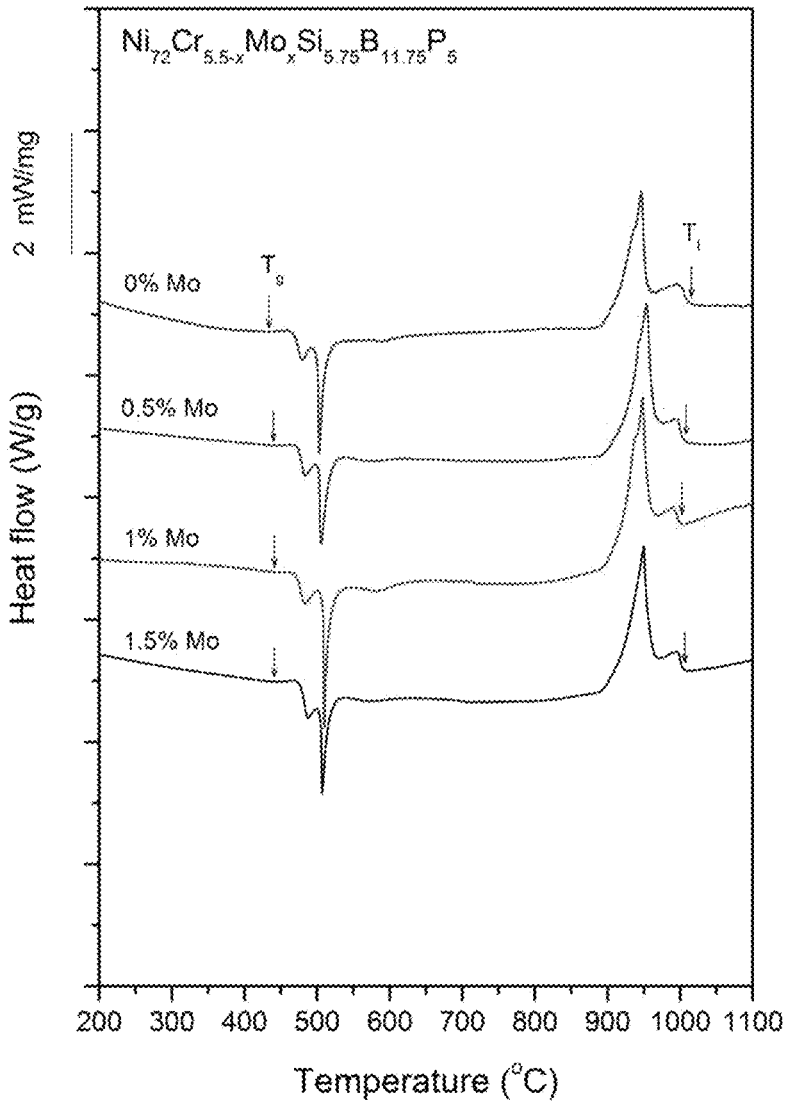
FIG. 13 provides a plot showing calorimetry scans having a scan rate of 20 K/min for sample metallic glasses $Ni_{72}Cr_{5.5-x}Mo_xSi_{5.75}B_{11.75}P_5$. Arrows from left to right designate the glass-transition and liquidus temperatures, respectively.

Sample metallic glasses (samples 35-39) showing the effect of substituting Cr by Mo, according to the formula $Ni_{72}Cr_{5.5-x}Mo_xSi_{5.75}B_{11.75}P_5$, are presented in Table 3 and FIG. 12, along with sample 30. As shown, when the Mo atomic percent is between 0.5 and 1, metallic glass rods with diameters equal to or greater than 2.5 mm and as high as 3 mm can be formed. The metallic glass rods in Table 3 were processed in fused silica tubes having 0.5 mm wall thickness. Differential calorimetry scans performed at a heating rate of 20 K/min for sample metallic glasses in which Cr is substituted by Mo are presented in FIG. 13.

TABLE 3

Sample metallic glasses demonstrating the effect of increasing the Mo atomic concentration at the expense of Cr on the glass forming ability of the Ni—Cr—Si—B—P alloy

| Example | Composition | Critical Rod Diameter [mm] |
|---|---|---|
| 30 | $Ni_{72}Cr_{5.5}Si_{5.75}B_{11.75}P_5$ | 2.5 |
| 35 | $Ni_{72}Cr_5Mo_{0.5}Si_{5.75}B_{11.75}P_5$ | 2.5 |
| 36 | $Ni_{72}Cr_{4.75}Mo_{0.75}Si_{5.75}B_{11.75}P_5$ | 3 |
| 37 | $Ni_{72}Cr_{4.5}Mo_1Si_{5.75}B_{11.75}P_5$ | 3 |
| 38 | $Ni_{72}Cr_{4.25}Mo_{1.25}Si_{5.75}B_{11.75}P_5$ | 1.5 |
| 39 | $Ni_{72}Cr_4Mo_{1.5}Si_{5.75}B_{11.75}P_5$ | 1.5 |

Figure 14:
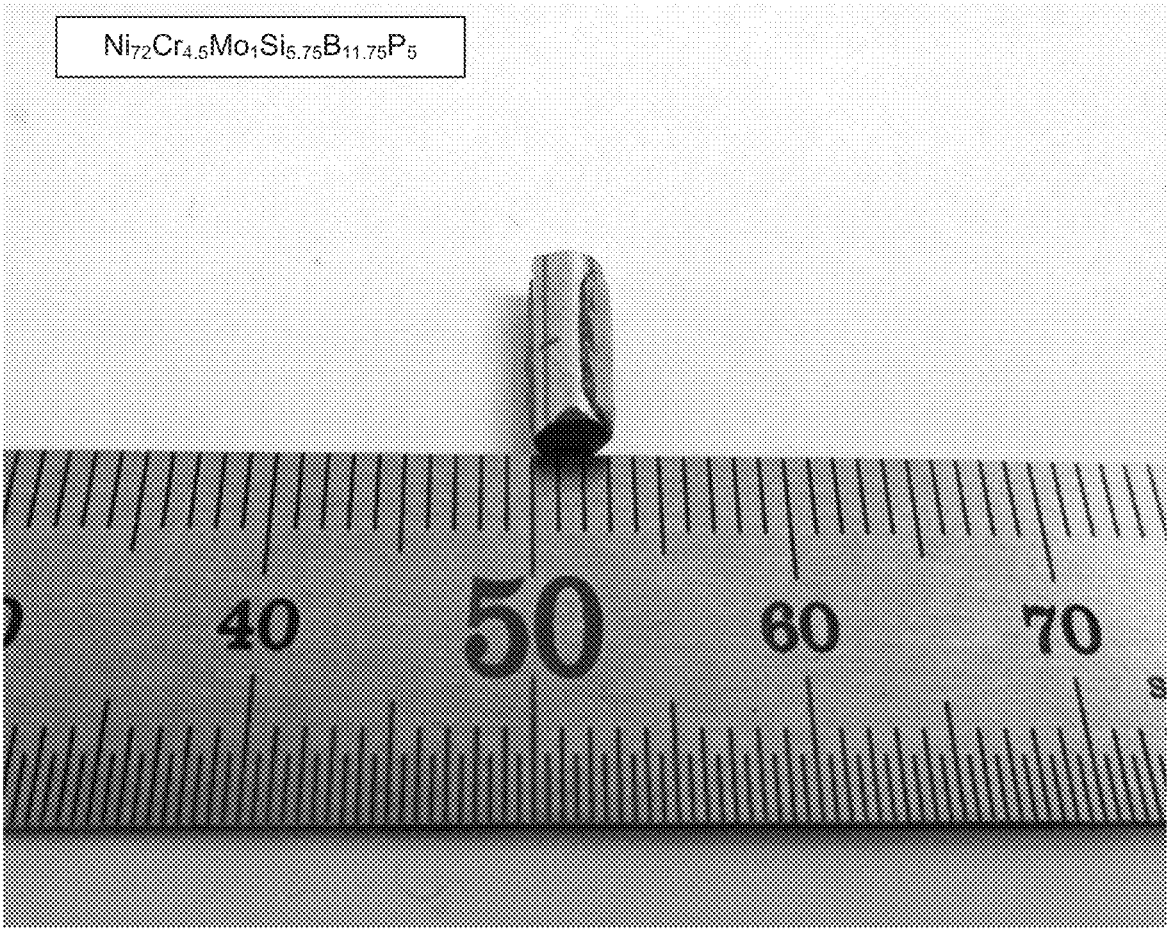
FIG. 14 provides an optical image of a 3 mm metallic glass having composition $Ni_{72}Cr_{4.5}Mo_1Si_{5.75}B_{11.75}P_5$.
Figure 15:
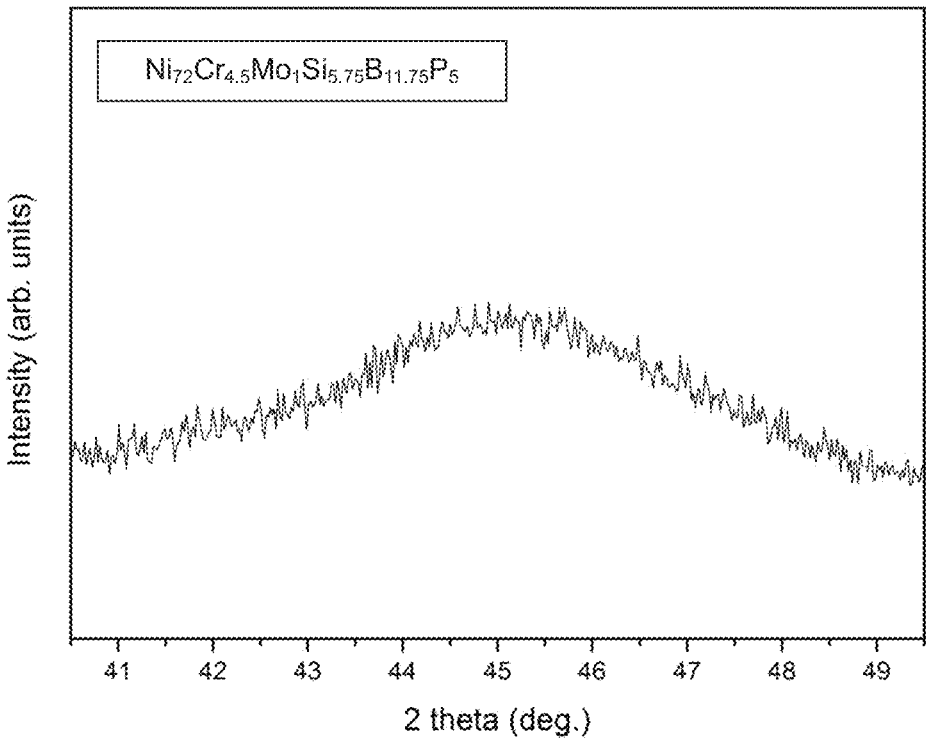
FIG. 15 provides an X-ray diffractogram verifying the amorphous structure of a 3 mm metallic glass rod having composition $Ni_{72}Cr_{4.5}Mo_1Si_{5.75}B_{11.75}P_5$.

Among the compositions in Table 3, the alloys exhibiting the highest glass-forming ability are Examples 36 and 37, having compositions $Ni_{72}Cr_{4.75}Mo_{0.75}Si_{5.75}B_{11.75}P_5$ and $Ni_{72}Cr_{45}Mo_1Si_{5.75}B_{11.75}P_5$, respectively. Both alloys are capable of forming metallic glass rods of up to 3 mm in diameter. An image of a 3 mm diameter amorphous $Ni_{72}Cr_{4.5}Mo_1Si_{5.75}B_{11.75}P_5$ rod is shown in FIG. 14. An x-ray diffractogram taken on the cross section of a 3 mm diameter $Ni_{72}Cr_{4.5}Mo_1Si_{5.75}B_{11.75}P_5$ (sample 38) rod verifying its amorphous structure is shown in FIG. 15.

The mechanical properties of the Ni—Cr—Mo—Si—B—P metallic glasses were investigated for sample alloys with various Mo concentrations. The mechanical properties include the compressive yield strength, $\sigma_y$, which is the measure of the material's ability to resist non-elastic yielding, and the stress intensity factor at crack initiation (i.e. the notch toughness), $K_q$, which is the measure of the material's ability to resist fracture in the presence of blunt notch. Specifically, the yield strength is the stress at which the material yields plastically, and the notch toughness is a measure of the work required to propagate a crack originating from a blunt notch. Another property of interest is the bending ductility of the material. The bending ductility is a measure of the material's ability to resist fracture in bending in the absence of a notch or a pre-crack. Lastly, another mechanical property of interest is the hardness, which is a measure of the material's ability to resist plastic indentation. These four properties characterize the material mechanical performance under stress. A high $\sigma_y$ ensures that the material will be strong; a high $K_q$ ensures that the material will be tough in the presence of relatively large defects; a high bending ductility ensures that the material will be ductile in the absence of large defects. The plastic zone radius, $r_p$, defined as $K_q^2/\pi\sigma_y^2$, is a measure of the critical flaw size at which catastrophic fracture is promoted. The plastic zone radius determines the sensitivity of the material to flaws; a high $r_p$ designates a low sensitivity of the material to flaws. Lastly, a high hardness will ensure that the material will be resistant to indentation and scratching.

Figure 16:
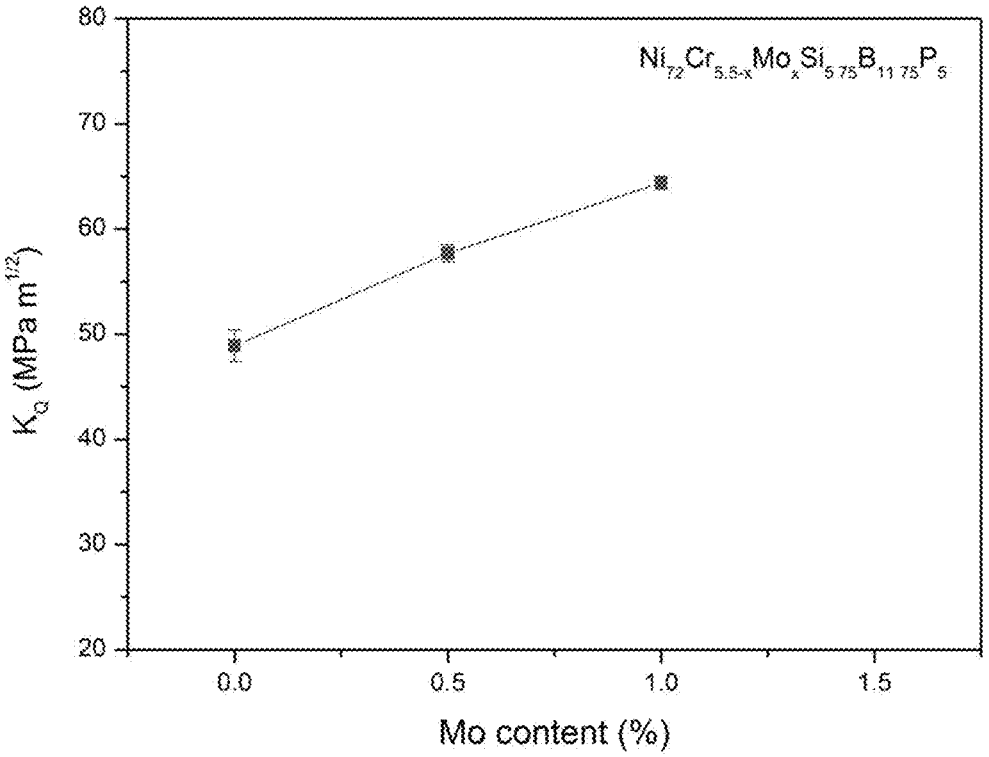
FIG. 16 provides a plot showing the effect of substituting Cr by Mo on the notch toughness of sample metallic glass having composition $Ni_{72}Cr_{5.5-x}Mo_xSi_{5.75}B_{11.75}P_5$.
Figure 17:
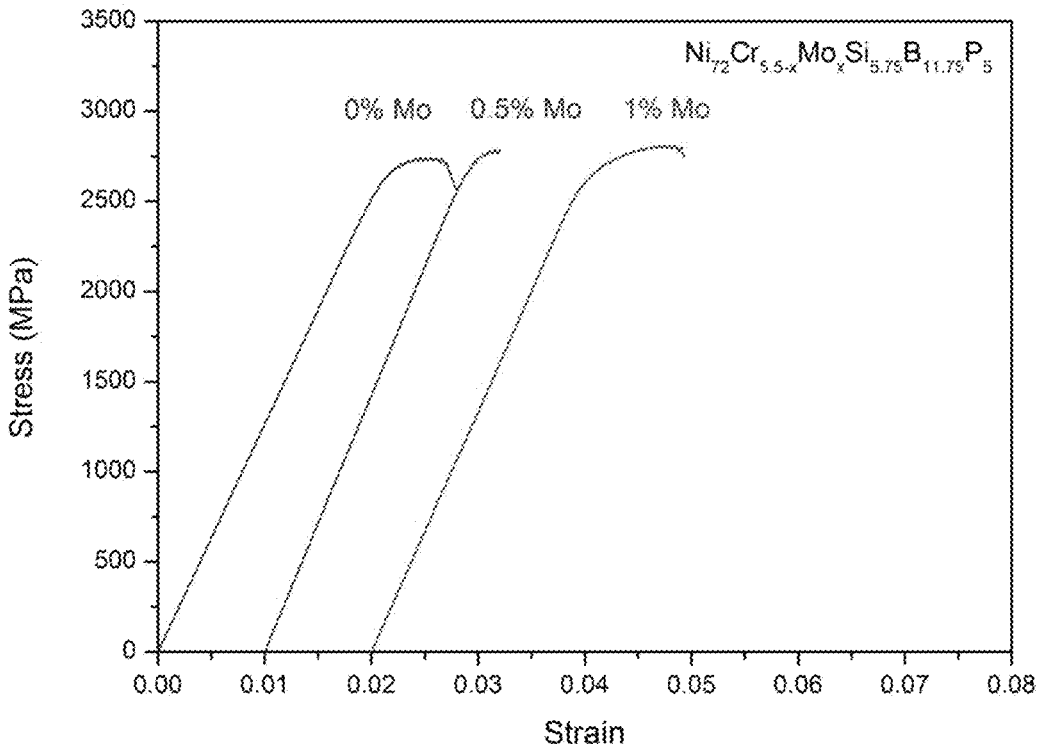
FIG. 17 provides compressive stress-strain diagrams for sample metallic glass having composition $Ni_{72}Cr_{5.5-x}MO_xSi_{5.75}B_{11.75}P_5$.

The measured yield strength and notch toughness of sample metallic glasses $Ni_{72}Cr_{5.5-x}Mo_xSi_{5.75}B_{11.75}P_5$, where x is 0, 0.5, and 1 (samples 30, 35, and 37), are listed along with the critical rod diameter in Table 4. The plastic zone radii $r_p$ for these metallic glasses are also presented in Table 4. The notch toughness of the metallic glasses appears to increase monotonically with increasing x, going from just under 50 MPa $m^{1/2}$ for the Mo-free metallic glass to about 65 MPa $m^{1/2}$ for the metallic glass containing 1 atomic percent Mo. This is shown graphically in FIG. 16. The yield strength appears to increase slightly from 2725 MPa for the Mo-free metallic glass to about 2785 MPa for the metallic glass containing 0.5 atomic percent Mo and back to 2720 MPa for the metallic glass containing 1 atomic percent Mo. The stress-strain diagrams for the three metallic glasses are presented in FIG. 17. The plastic zone radius is roughly constant at about 0.135 mm between the metallic glasses containing 0 and 0.5 atomic percent Mo, as the enhancement in toughness is approximately balanced by the enhancement in strength. However, for the metallic glass containing 1 atomic percent Mo the plastic zone radius of the metallic glass is increased to 0.178 mm, which is a consequence of its enhanced toughness. Lastly, the HV0.5 hardness of metallic glass $Ni_{72}Cr_{4.5}Mo_1Si_{5.75}B_{11.75}P_5$ is measured to be 768.3±9.6 kgf/$mm^2$. The hardness of all metallic glass compositions according to the current disclosure is expected to be over 750 kgf/$mm^2$.

TABLE 4

Critical rod diameter, notch toughness, yield strength and plastic zone radius of Ni—Cr—Mo—Si—B—P metallic glasses

| Sample | Composition | Critical Rod Diameter $d_c$ [mm] | Notch Toughness $K_q$ [MPa $m^{1/2}$] | Yield Strength $\sigma_y$ [MPa] | Plastic Zone Radius $r_p$ [mm] |
|---|---|---|---|---|---|
| 30 | $Ni_{72}Cr_{55}Si_{5.75}B_{11.75}P_5$ | 2.5 | 48.9 ± 1.5 | 2725 | 0.134 |
| 35 | $Ni_{72}Cr_5Mo_{0.5}Si_{5.75}B_{11.75}P_5$ | 2.5 | 57.7 ± 0.8 | 2785 | 0.136 |
| 37 | $Ni_{72}Cr_{4.5}Mo_1Si_{5.75}B_{11.75}P_5$ | 3 | 64.4 ± 0.6 | 2720 | 0.178 |

Figure 18:
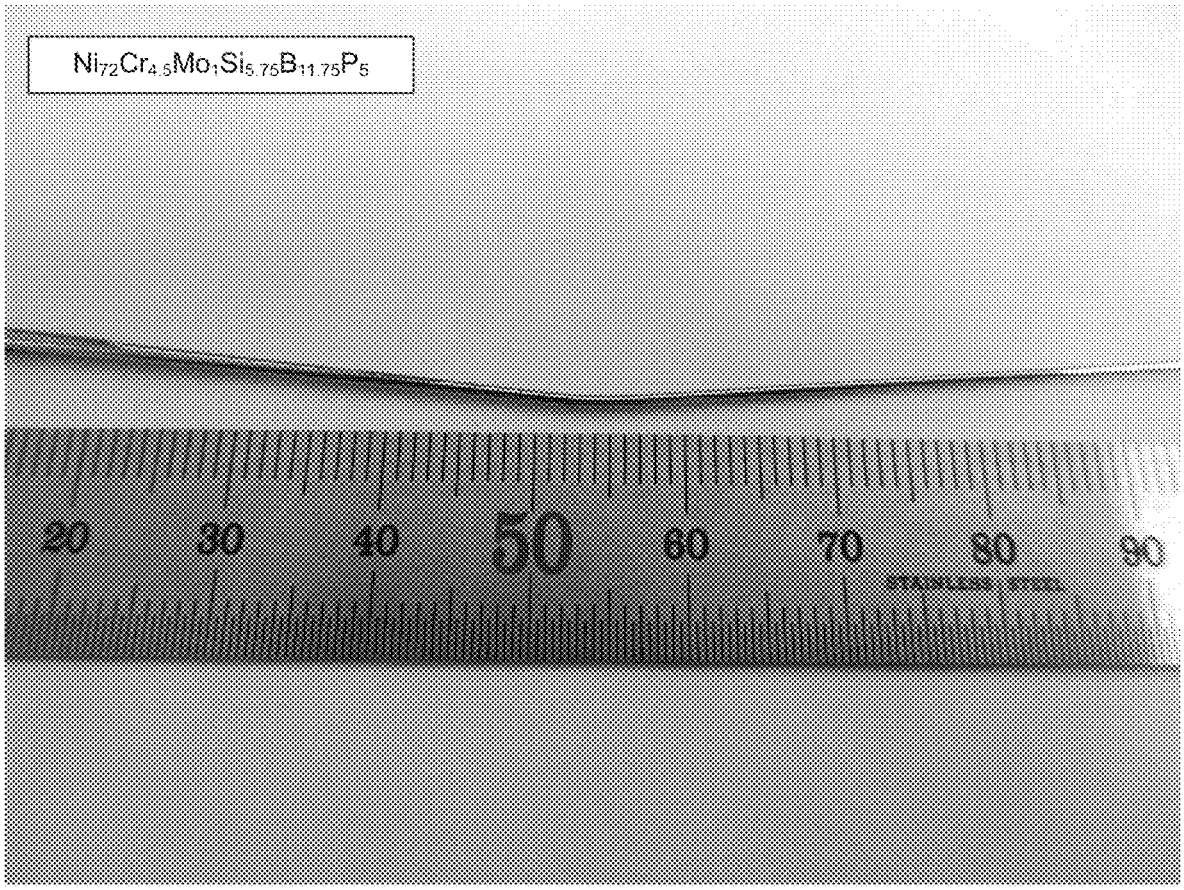
FIG. 18 provides an optical image of a plastically bent 1 mm metallic glass rod having composition $Ni_{72}Cr_{45}Mo_1Si_{5.75}B_{11.75}P_5$.

The metallic glasses Ni—Cr—Mo—Si—B—P also exhibit a remarkable bending ductility, similar to the Ni—Cr—Si—B—P alloys shown in FIG. 11. Specifically, under an applied bending load, the metallic glasses are capable of undergoing plastic bending in the absence of fracture for diameters up to at least 1 mm. An optical image of a plastically bent metallic glass rod at 1-mm diameter section of example metallic glass $Ni_{72}Cr_{4.5}Mo_1Si_{5.75}B_{11.75}P_5$ is presented in FIG. 18.

Figure 19:
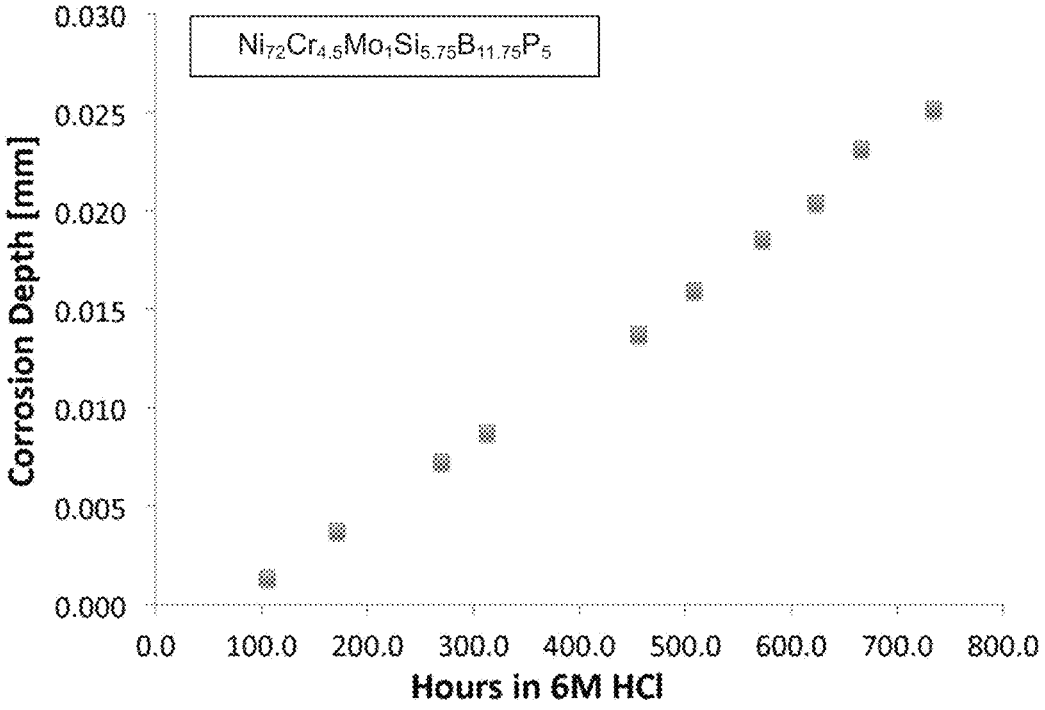
FIG. 19 provides a plot showing the corrosion depth versus time in 6M HCl solution of a 2 mm metallic glass rod having composition $Ni_{72}Cr_{4.5}Mo_1Si_{5.75}B_{11.75}P_5$.

Lastly, the metallic glasses Ni—Cr—Mo—Si—B—P also exhibit a remarkable corrosion resistance. The corrosion resistance of example metallic glass $Ni_{72}Cr_{4.5}Mo_1Si_{5.75}B_{11.75}P_5$ is evaluated by immersion test in 6M HCl. The density of the metallic glass rod was measured using the Archimedes method to be 7.9 g/cc. A plot of the corrosion depth versus time is presented in FIG. 19. The corrosion depth at approximately 735 hours is measured to be about 25 micrometers. The corrosion rate is estimated to be 0.33 mm/year. The corrosion rate of all metallic glass compositions according to the current disclosure is expected to be under 1 mm/year.

Description of Methods of Processing the Alloys

A method for producing the alloys involves inductive melting of the appropriate amounts of elemental constituents in a quartz tube under inert atmosphere. The purity levels of the constituent elements were as follows: Ni 99.995%, Cr 99.996% (single crystal), Mo 99.95%, Si 99.9999%, B 99.5%, P 99.9999%.

The alloy ingots may be fluxed with a reducing agent such as dehydrated boron oxide ($B_2O_3$). A method for fluxing the alloys of the present disclosure involves melting the ingots and $B_2O_3$ in a quartz tube under inert atmosphere, bringing the alloy melt in contact with the $B_2O_3$ melt and allowing the two melts to interact for at least 500 seconds, and in some embodiments 1500 seconds, at a temperature of at least 1100° C., and in some embodiments between 1200 and 1400° C., and subsequently quenching in a bath of room temperature water.

A method for producing metallic glass rods from the alloy ingots involves re-melting the fluxed ingots in quartz tubes in a furnace at a temperature of at least 1100° C., in some embodiments between 1200° C. and 1400° C., under high purity argon and rapidly quenching the molten alloy in a room-temperature water bath. The quartz tubes may have a wall thickness ranging from 0.05 mm to 0.5 mm.

In various embodiments, metallic glasses comprising the alloy of the present disclosure can be produced by: (1) re-melting the fluxed ingots in quartz tubes, holding the melt at a temperature of about 1100° C. or higher, and in some embodiments between 1200° C. and 1400° C., under inert atmosphere, and rapidly quenching in a liquid bath; or (2) re-melting the fluxed ingots, holding the melt at a temperature of about 1100° C. or higher, and in some embodiments between 1200° C. and 1400° C., under inert atmosphere, and injecting or pouring the molten alloy into a metal mold, which may be made of copper, brass, or steel.

Test Methodology for Differential Scanning Calorimetry

Differential scanning calorimetry at a scan rate of 20 K/min was performed to determine the glass-transition, crystallization, solidus, and liquidus temperatures of sample metallic glasses.

Test Methodology for Assessing Glass-Forming Ability

The glass-forming ability of each alloy was assessed by determining the maximum rod diameter in which the amorphous phase can be formed when processed by the method described above. X-ray diffraction with Cu—Kα radiation was performed to verify the amorphous structure of the alloys. Images of fully amorphous rods made from the alloys of the present disclosure with diameters ranging from 3 to 10 mm are provided in FIG. 9.

Test Methodology for Measuring Notch Toughness

The notch toughness of sample metallic glasses was performed on 2-mm diameter metallic glass rods. The rods were notched using a wire saw with a root radius of between 0.10 and 0.13 μm to a depth of approximately half the rod diameter. The notched specimens were placed on a 3-point bending fixture with span distance of 12.7 mm and carefully aligned with the notched side facing downward. The critical fracture load was measured by applying a monotonically increasing load at constant cross-head speed of 0.001 mm/s using a screw-driven testing frame. At least three tests were performed, and the variance between tests is included in the notch toughness plots. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)).

Test Methodology for Measuring Compressive Yield Strength

Compression testing of sample metallic glasses was performed on cylindrical specimens 2 mm in diameter and 4 mm in length by applying a monotonically increasing load at constant cross-head speed of 0.001 mm/s using a screw-driven testing frame. The strain was measured using a linear variable differential transformer. The compressive yield strength was estimated using the 0.2% proof stress criterion.

Test Methodology for Measuring Hardness

The hardness was measured using a Vickers microhardness tester. Nine tests were performed where micro-indentions were inserted on a flat and polished cross section of a 2-mm metallic glass rod of composition $Ni_{72}Cr_{4.5}Mo_1Si_{5.75}B_{11.75}P_5$ using a load of 500 g and a duel time of 10 s.

Test Methodology for Measuring Corrosion Resistance

The corrosion resistance was evaluated by immersion tests in hydrochloric acid (HCl). A rod of metallic glass $Ni_{72}Cr_{4.5}Mo_1Si_{5.75}B_{11.75}P_5$ with initial diameter of 1.97 mm and length of 19.31 mm was immersed in a bath of 6M HCl at room temperature. The corrosion depth at various stages during the immersion was estimated by measuring the mass change with an accuracy of ±0.01 mg. The corrosion rate was estimated assuming linear kinetics.

The present Ni—Si—B based alloys with additions of Cr, P, or Mo demonstrate better glass forming ability than the Ni—Si—B alloys. Specifically, the present alloys Ni—Cr—Si—B with Cr substituting Ni in the Ni—Si—B alloys have better glass forming ability than the Cr-free Ni—Si—B alloys. The present alloys Ni—Cr—Si—B—P with P substituting Si in the Ni—Cr—Si—B alloys have better glass forming ability than the P-free Ni—Cr—Si—B alloys. The present alloys Ni—Cr—Mo—Si—B—P with Mo substituting Cr in the Ni—Cr—Si—B—P alloys have better glass forming ability than the Mo-free Ni—Cr—Si—B—P alloys. The metallic glasses also demonstrate high strength and hardness, high toughness and bending ductility, as well as high corrosion resistance.

The combination of high glass-forming ability and the excellent mechanical and corrosion performance of the bulk Ni-based metallic glasses make them excellent candidates for various applications. For example, among many other applications, the present alloys may be used in consumer electronics, dental, medical, luxury goods and sporting goods applications.

Having described several embodiments, it will be recognized by those skilled in the art that various modifications, alternative constructions, and equivalents may be used without departing from the spirit of the disclosure. Additionally, a number of well-known processes and elements have not been described in order to avoid unnecessarily obscuring the present disclosure. Accordingly, the above description should not be taken as limiting the scope of the disclosure.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A metallic glass having the formula consisting of:

$$Ni_{(100-a-b-c-d)}Cr_aSi_bB_cP_d$$

wherein the atomic percent of chromium (Cr) a is between 3 and 8, the atomic percent of silicon (Si) b is greater than 5 and not greater than 12, the atomic percent of boron (B) c is between 9 and 13, the atomic percent of phosphorus (P) d is between 0.5 and 8, and the balance is Ni, and wherein the critical rod diameter of the metallic glass is at least 2 mm.

2. The metallic glass of claim 1, wherein the atomic percent of Cr a is between 4.5 and 6.5.

3. The metallic glass of claim 1, wherein the metallic glass is selected from a group consisting of $Ni_{71.5}Cr_{5.5}Si_6B_{12}P_5$, $Ni_{72}Cr_{5.5}Si_{5.75}B_{11.75}P_5$, $Ni_{72}Cr_{5.5}Si_6B_{11.5}P_5$, $Ni_{71.75}Cr_{5.75}Si_{5.75}B_{11.75}P_5$, $Ni_{72}Cr_{5.5}Si_{5.5}B_{11.75}P_{5.25}$, and $Ni_{72.25}Cr_{5.25}Si_{5.75}B_{11.75}P_5$.

4. The metallic glass of claim 1, wherein the combined atomic percent of Si, B, and P is between 21.5 and 23.5.

5. The metallic glass of claim 1, wherein the combined atomic percent of Si, B, and P is between 22 and 23, wherein the critical rod diameter of the metallic glass is at least 2.5 mm.

6. The metallic glass of claim 1, wherein the combined atomic percent of Si, B, and P is between 21 and 24.

7. A method of producing the metallic glass of claim 1 comprising:

melting an alloy into a molten state, the alloy having the composition consisting of $Ni_{(100-a-b-c-d)}Cr_aSi_bB_cP_d$, wherein an atomic percent of chromium (Cr) a is between 3 and 8, an atomic percent of silicon (Si) b is greater than 5 and not greater than 12, an atomic percent of boron (B) c is between 9 and 13, an atomic percent of phosphorus (P) d is between 0.5 and 8, and the balance is Ni; and quenching the molten alloy at a cooling rate sufficiently rapid to prevent crystallization of the alloy, wherein the critical rod diameter of the metallic glass is at least 2 mm.

8. A metallic glass having the formula consisting of:

$$Ni_{(100-a-b-c-d-e)}Cr_aSi_bB_cP_dX_e$$

wherein the atomic percent of chromium (Cr) a is between 3 and 8, the atomic percent of silicon (Si) b is greater than 5 and not greater than 12, the atomic percent of boron (B) c is between 9 and 13, the atomic percent of phosphorus (P) d is between 0.5 and 8, wherein X is one or more optional elements selected from a group consisting of Co, Mn, W, Ru, Re, Pd, Pt, Nb, V, and Ta, wherein the atomic percent of the optional elements (X) e is up to 2, and wherein the balance is Ni; and wherein the critical rod diameter of the metallic glass is at least 2 mm.

* * * * *